US010155263B2

(12) United States Patent
Arnold

(10) Patent No.: US 10,155,263 B2
(45) Date of Patent: Dec. 18, 2018

(54) CONTINUOUS CASTING OF MATERIALS USING PRESSURE DIFFERENTIAL

(71) Applicant: ATI Properties LLC, Albany, OR (US)

(72) Inventor: Matthew J. Arnold, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 381 days.

(21) Appl. No.: 13/629,696

(22) Filed: Sep. 28, 2012

(65) Prior Publication Data

US 2014/0090792 A1 Apr. 3, 2014

(51) Int. Cl.

| | |
|---|---|
| ***B22D 11/113*** | (2006.01) |
| ***B22D 11/116*** | (2006.01) |
| ***B22D 11/117*** | (2006.01) |
| ***B22D 11/128*** | (2006.01) |
| ***B22D 11/16*** | (2006.01) |

(Continued)

(52) U.S. Cl.

CPC ..... *B22D 11/16* (2013.01); *B22D 11/0622* (2013.01); *B22D 11/113* (2013.01); *B22D 11/117* (2013.01); *B22D 11/126* (2013.01); *B22D 11/128* (2013.01); *B22D 11/141* (2013.01); *B22D 11/142* (2013.01);

(Continued)

(58) Field of Classification Search

CPC ..... B22D 11/04; B22D 11/041; B22D 11/08; B22D 11/081; B22D 11/083; B22D 11/085; B22D 11/088; B22D 11/113; B22D 11/116; B22D 11/117; B22D 11/128; B22D 11/1281; B22D 11/1287

See application file for complete search history.

(56) References Cited

U.S. PATENT DOCUMENTS

| | | | |
|---|---|---|---|
| 2,963,001 | A | 12/1960 | Alexander |
| 3,367,667 | A | 2/1968 | Allen |

(Continued)

FOREIGN PATENT DOCUMENTS

| | | | |
|---|---|---|---|
| JP | S63-165047 | A | 7/1988 |
| JP | 5-31568 | A | 2/1993 |

(Continued)

*Primary Examiner* — Kevin E Yoon
*Assistant Examiner* — Jacky Yuen
(74) *Attorney, Agent, or Firm* — K&L Gates LLP

(57) ABSTRACT

A system and method for continuous casting. The system includes a melt chamber, a withdrawal chamber, and a secondary chamber therebetween. The melt chamber can maintain a melting pressure and the withdrawal chamber can attain atmospheric pressure. The secondary chamber can include regions that can be adjusted to different pressures. During continuous casting operations, the first region adjacent to the melt chamber can be adjusted to a pressure that is at least slightly greater than the melting pressure; the pressure in subsequent regions can be sequentially decreased and then sequentially increased. The pressure in the final region can be at least slightly greater than atmospheric pressure. The differential pressures can form a dynamic airlock between the melt chamber and the withdrawal chamber, which can prevent infiltration of the melt chamber by non-inert gas in the atmosphere, and thus can prevent contamination of reactive materials in the melt chamber.

12 Claims, 11 Drawing Sheets

(51) Int. Cl.

| | |
|---|---|
| ***B22D 11/126*** | (2006.01) |
| ***B22D 11/14*** | (2006.01) |
| ***B22D 11/06*** | (2006.01) |
| ***B22D 11/20*** | (2006.01) |
| ***B22D 27/00*** | (2006.01) |
| ***B22D 27/15*** | (2006.01) |

(52) U.S. Cl.
CPC ..... *B22D 11/163* (2013.01); *B22D 11/20* (2013.01); *B22D 27/003* (2013.01); *B22D 27/15* (2013.01)

(56) References Cited

U.S. PATENT DOCUMENTS

| | | | | | |
|---|---|---|---|---|---|
| 3,764,297 | A | * | 10/1973 | Coad et al. | 75/10.23 |
| 3,800,848 | A | | 4/1974 | Chaulet et al. | |
| 3,847,205 | A | | 11/1974 | Soykan et al. | |
| 3,888,300 | A | * | 6/1975 | Guichard et al. | 164/450.2 |
| 4,000,771 | A | * | 1/1977 | Williamson | 164/484 |
| 4,559,992 | A | * | 12/1985 | Bedell et al. | 164/463 |
| 4,610,296 | A | * | 9/1986 | Hiratake et al. | 164/469 |
| 4,821,791 | A | | 4/1989 | Aichert et al. | |
| 5,000,114 | A | | 3/1991 | Yanagi et al. | |
| 5,018,569 | A | | 5/1991 | Burau et al. | |
| 5,222,547 | A | | 6/1993 | Harker | |
| 5,972,282 | A | | 10/1999 | Aguirre et al. | |
| 6,019,812 | A | | 2/2000 | Volas et al. | |
| 6,273,179 | B1 | | 8/2001 | Geltser et al. | |
| 8,196,641 | B2 | | 6/2012 | Jacques et al. | |
| 2004/0055730 | A1 | * | 3/2004 | Jackson | B22D 41/00 164/136 |
| 2011/0308760 | A1 | * | 12/2011 | Tanaka | B22D 11/00 164/494 |
| 2012/0037330 | A1 | | 2/2012 | Popper | |
| 2016/0167121 | A1 | | 6/2016 | Arnold | |

FOREIGN PATENT DOCUMENTS

| | | | |
|---|---|---|---|
| KZ | 19806 | A | 8/2008 |
| RU | 2420386 | C2 | 6/2011 |

* cited by examiner

CONTINUOUS CASTING OF MATERIALS USING PRESSURE DIFFERENTIAL

FIELD OF TECHNOLOGY

The present disclosure generally relates to systems, methods, tools, techniques, and strategies for casting molten material. In certain embodiments, the disclosure relates to continuous casting of molten material.

BACKGROUND OF THE INVENTION

A furnace, such as a plasma arc or electron beam cold hearth melting furnace, for example, can melt and cast material for periods of time. During continuous casting operations, molten material can continuously enter a mold and cast material, or ingot, can continuously emerge from the mold. For example, molten material can flow into the top of the mold while a withdrawal mechanism continuously translates to allow cast material to emerge from the bottom of the mold. Continuous casting can reduce the frequency of interruptions to casting operations, such as delays associated with changing the mold between casting cycles, for example. Reducing interruptions during casting operations can increase casting efficiency.

Some materials are reactive when molten or at high temperature. A material that is reactive in this way, when in a molten state or heated to or above a particular temperature, will readily chemically combine or otherwise chemically change when exposed to certain elements or compounds. For example, molten titanium and solid cast titanium at very high temperature are reactive and readily chemically combine with gaseous oxygen to form titanium dioxide and with gaseous nitrogen to form titanium nitride. Titanium dioxide and titanium nitride may form hard alpha defects in cast titanium and make it unsuitable for intended applications. Consequently, molten titanium and high temperature cast titanium preferably are maintained in a vacuum or in an inert atmosphere during certain stages of the casting operation. In an electron beam cold hearth furnace, a high or substantial vacuum is maintained in the melting and casting chambers to allow the electron beam guns to operate. In a plasma arc cold hearth furnace, plasma torches use an inert gas such as helium or argon, for example, to produce plasma. Accordingly, in a plasma arc cold hearth furnace, the presence of the inert gas for the plasma torches generates a pressure in the furnace that can range from sub-atmospheric to a positive pressure. If the melt chamber of a plasma arc or electron beam cold hearth melting furnace is infiltrated with a non-inert gas, such as oxygen or nitrogen, for example, the non-inert gas can contaminate the molten material therein. Thus, gas from the external atmosphere should be completely or substantially prevented from entering the melt chamber of a furnace containing molten titanium.

It would be advantageous to provide a continuous casting system that is less susceptible to contamination of titanium or another reactive material contained therein. More generally, it would be advantageous to provide an improved continuous casting system that is useful for titanium, other reactive materials, and metals and metal alloys generally.

SUMMARY OF THE INVENTION

An aspect of the present disclosure is directed to a non-limiting embodiment of a system for melting and casting a material. The system comprises a melt chamber, a secondary chamber, and a withdrawal chamber. The melt chamber is structured to operably attain a melting pressure therein. Further, the secondary chamber comprises a plurality of regions and at least one pressure management element. The plurality of regions comprises a first region positioned adjacent to the melt chamber, and the first region is structured to operably attain a first differential pressure therein that is greater than the melting pressure. Each pressure management element controls a flow of gas between adjacent regions of the plurality of regions. Additionally, the withdrawal chamber is positioned adjacent to the secondary chamber, and the withdrawal chamber is structured to operably attain atmospheric pressure therein.

The secondary chamber may comprise an inner perimeter, and each pressure management element may comprise a baffle and a central aperture for receiving cast material therethrough. The baffle of each pressure management element may extend from the inner perimeter to the central aperture. The melt chamber may comprise a mold for casting material. The cast material may pass from the mold, through the central aperture of the at least one pressure management element of the secondary chamber, and into the withdrawal chamber. The plurality of regions may comprise a second region adjacent to the first region, and the second region may be structured to operably attain a second differential pressure that is less than the first differential pressure. The system may comprise a plurality of pumps structured to adjust the pressure in the plurality of regions of the secondary chamber. The system may comprise a withdrawal cart structured to move the withdrawal chamber away from the secondary chamber, and the withdrawal chamber may be structured to attain atmospheric pressure therein upon moving away from the secondary chamber. The system may comprise rollers structured to operably extend toward the cast material withdrawn from the secondary chamber.

Another aspect of the present disclosure is directed to a non-limiting embodiment of a method for casting material. The method comprises controlling the pressure in a melt chamber, a secondary chamber, and a withdrawal chamber. The pressure within the melt chamber is controlled to a melting pressure. The method also comprises passing cast material from the melt chamber into the secondary chamber, wherein the secondary chamber comprises a plurality of regions, and wherein the plurality of regions comprises a first region adjacent to the melt chamber. The method further comprises passing the material from the secondary chamber into the withdrawal chamber. The method also comprises controlling the pressure of the first region from the melting pressure to a first differential pressure that is greater than the melting pressure. The method further comprises controlling the pressure of the withdrawal chamber from the melting pressure to atmospheric pressure.

The method may comprise controlling the pressure of a second region of the secondary chamber to a second differential pressure that is less than the first differential pressure, wherein the second region is adjacent to the first region. The method may comprise controlling the pressure of a final region of the secondary chamber to a final differential pressure that is greater than atmospheric pressure, wherein the final region is operably positioned adjacent to the withdrawal chamber. The method may comprise controlling the pressure in regions positioned between the second region and an intermediate region of the secondary chamber, wherein the pressures are adjusted from the melting pressure to pressures that sequentially decrease from the second region to the intermediate region. The method may comprise controlling the pressure in regions of the secondary chamber located between the intermediate region and the final region, wherein the pressures are adjusted from the melting pressure to pressures that sequentially increase from the intermediate region to the final region. The method may comprise applying energy to material in the melt chamber to melt the material. The method may comprise passing the cast material through the secondary chamber and into the withdrawal chamber using a withdrawal mechanism. The method may comprise releasing the withdrawal chamber from the secondary chamber to control the pressure of the withdrawal chamber from the melting pressure to atmospheric pressure. The method may comprise extending a set of rollers to contact the cast material. The method may comprise cutting the cast material with a cutting device. The method may comprise unloading a cut segment of the cast material onto an unloading cart.

Yet another aspect of the present disclosure is directed to a non-limiting embodiment of a chamber for a continuous casting furnace. The chamber comprises an inner perimeter, a plurality of regions, and at least one baffle for controlling gas flow between adjacent regions of the plurality of regions. The plurality of regions comprises a first region positioned adjacent to a melt chamber of the furnace, wherein the melt chamber is structured to operably attain a melting pressure, and wherein the first region is structured to operably attain a first differential pressure that is greater than the melting pressure. The plurality of regions also comprises a second region positioned adjacent to the first region, wherein the second region is structured to operably attain a second differential pressure that is less than the first differential pressure. Each baffle comprises an aperture, and each baffle extends from the inner perimeter of the chamber to the aperture.

BRIEF DESCRIPTION OF THE FIGURES

The features and advantages of the present invention may be better understood by reference to the accompanying figures in which.

DESCRIPTION

Figure 1:
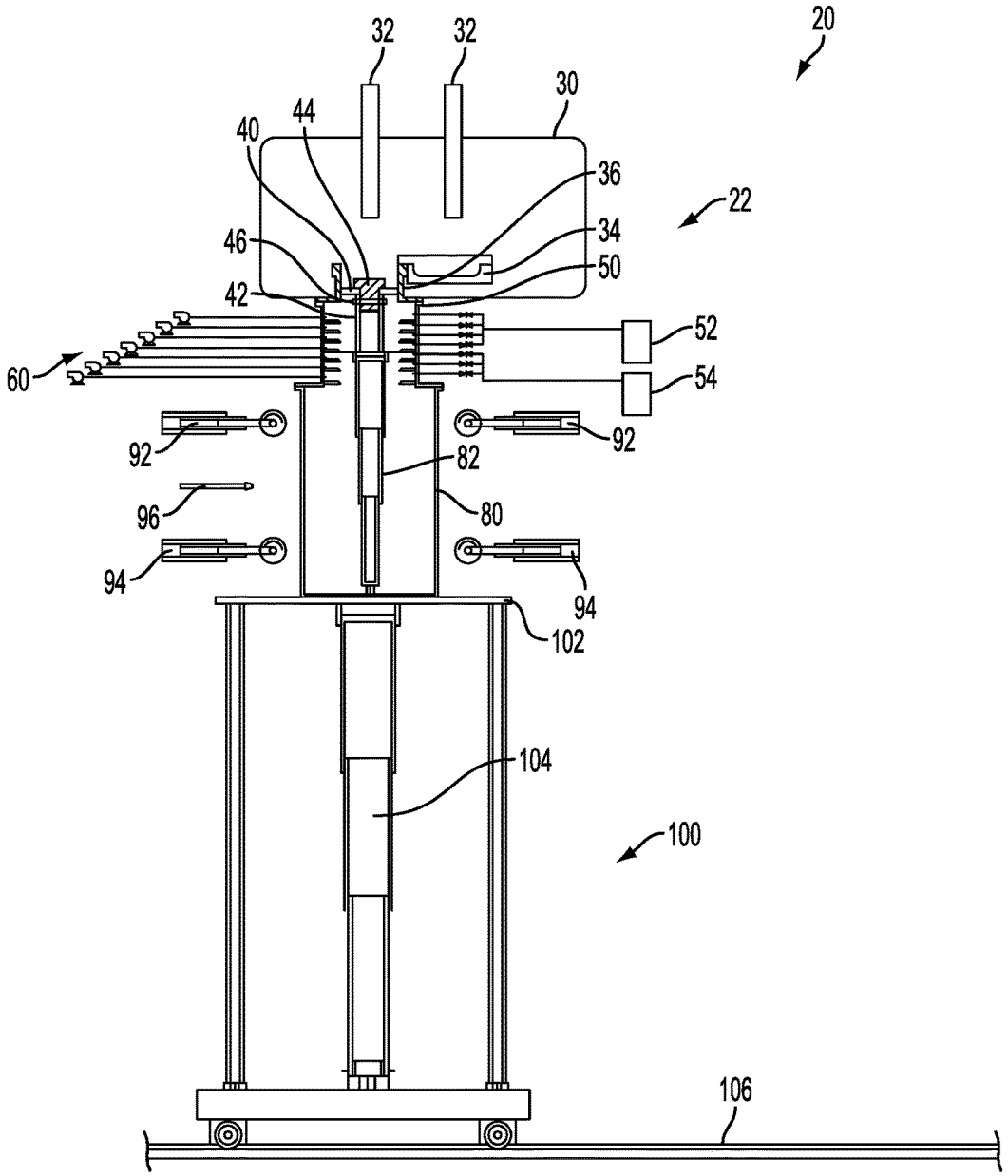
FIG. 1 is a schematic of a continuous casting system according to at least one non-limiting embodiment of the present disclosure.

Various non-limiting embodiments disclosed and described in this specification are directed to continuous casting systems for metal and metal alloys. In certain non-limiting embodiments, the metals or metal alloys are reactive materials. One non-limiting application described and illustrated herein is a secondary chamber between a melt chamber and a withdrawal chamber of a melting and casting system, wherein the melt chamber is adapted for plasma arc or electron beam cold hearth melting. However, it will be understood that the secondary chamber may be used with any melt chamber, such as melt chambers adapted for coreless induction and/or channel-type induction melting, for example.

In various non-limiting embodiments, a continuous casting system can include a melt chamber, a withdrawal chamber, and a secondary chamber positioned between the melt chamber and the withdrawal chamber. In some embodiments, the melt chamber can include an energy source that can apply energy to and melt a material positioned therein. The molten material can pass into a mold of the melt chamber for casting. When the material is suitably solidified, it can be removed from the mold and withdrawn through the secondary chamber and into the withdrawal chamber. It will be understood that all or regions of the material may still be molten or partially molten when removed from the mold. Initially, a desired melting pressure can be attained throughout the melt chamber, the secondary chamber, and the withdrawal chamber. The desired melting pressure can be a vacuum, an intermediate pressure less that atmospheric pressure or a positive pressure above atmospheric pressure, for example. If the desired melting pressure is a positive pressure, gas can be introduced to the continuous casting system. An inert gas can be used in the chambers and/or the areas of the continuous casting system where the material could react with a non-inert gas. For example, an inert gas can be used in the melt chamber for melting and casting a material such as titanium, which is reactive when molten. In at least one embodiment, the melt chamber can be maintained at the desired melting pressure throughout the continuous casting operation. Further, in some embodiments, the pressure in the withdrawal chamber can be adjusted to atmospheric pressure. For example, the withdrawal chamber can be released from the secondary chamber to provide space for the lengthening casting or cast material to exit the continuous casting system. When the withdrawal chamber is moved away from the secondary chamber, the withdrawal chamber can attain atmospheric pressure.

In various non-limiting embodiments, the pressure in the secondary chamber can be adjusted or controlled during the continuous casting operations. For example, the secondary chamber can include a plurality of regions. Furthermore, a pressure management element, as well as the cast material positioned through an aperture in the pressure management element, can control the flow of gas between adjacent regions of the plurality of regions. In other words, adjacent regions in the secondary chamber can be controlled to and maintained at different pressures. In various non-limiting embodiments, a first region adjacent to the melt chamber can be adjusted to a pressure that is at least slightly higher than the desired melting pressure. In at least one embodiment, regions between the first region and an intermediate region of the secondary chamber can be adjusted to sequentially and incrementally decreasing pressures. In some embodiments, a final region of the secondary chamber adjacent to the withdrawal chamber can be adjusted to a pressure that is slightly higher than atmospheric pressure. In at least one embodiment, regions between the intermediate region and the final region can be adjusted to sequentially incrementally increasing pressures. In other words, the first region can be a first high pressure region, the intermediate region can be a lower pressure region, and the final region can be a second high pressure region.

In various non-limiting embodiments, the secondary chamber can form a dynamic airlock between the melt chamber and the withdrawal chamber. For example, the higher pressure in the first region and the decreasing pressure from the first region to a subsequent region of the secondary chamber can direct or guide gas away from the first region and the melt chamber and toward the subsequent region of the secondary chamber. By directing gas away from the melt chamber, contamination of reactive material in the melt chamber can be avoided. Additionally, the higher pressure in the final region of the secondary chamber can prevent gas from flowing into the final region from the withdrawal chamber and/or from the external atmosphere adjacent to the final region of the secondary chamber. By limiting infiltration of atmospheric gases into the secondary chamber, contamination of reactive material in the melt chamber can be further prevented.

Referring to FIGS. 1-10, a non-limiting embodiment of a continuous casting system 20 can include a furnace 22 for melting and/or casting material. In various non-limiting embodiments, the furnace 22 can include a plasma arc cold hearth melting furnace or an electron beam cold hearth melting furnace. In alternative embodiments, another suitable furnace can be used to melt the material in the continuous casting system 20. In some embodiments, the continuous casting system 20 can include a melt chamber 30, a secondary chamber 50, and/or a withdrawal chamber 80. The furnace 22 can melt the material 24 positioned in the melt chamber 30, for example. In at least one embodiment, the secondary chamber 50 can be adjacent to the melt chamber 30 and the withdrawal chamber 80 can be adjacent to the secondary chamber 50. For example, the secondary chamber 50 can be positioned between the melt chamber 30 and the withdrawal chamber 80.

Figure 7:
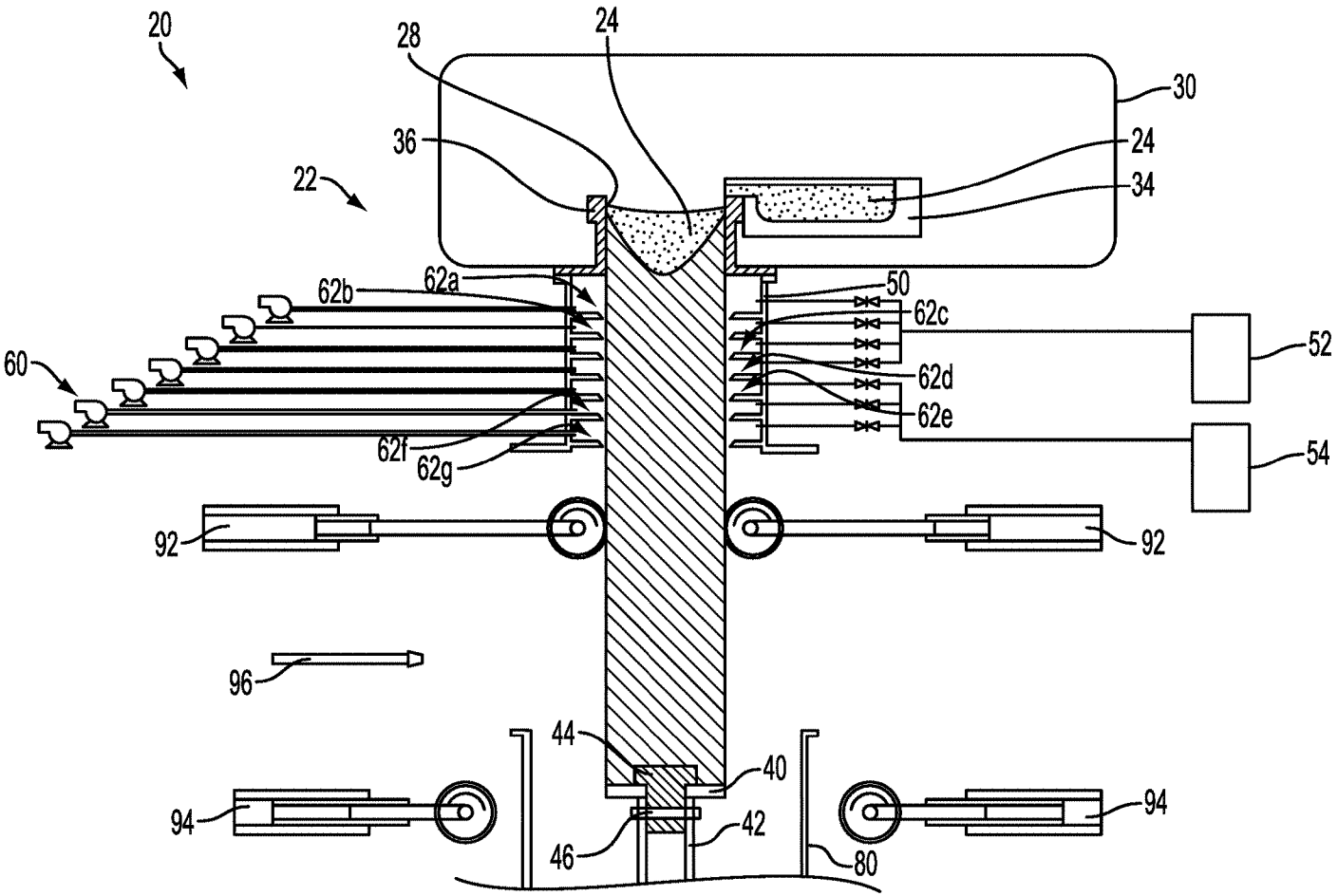
FIG. 7 is a partial schematic of the continuous casting system of FIG. 1 showing the withdrawal chamber released from the secondary chamber and the primary rollers extending toward the cast material.

Referring primarily to FIG. 1, the melt chamber 30, the secondary chamber 50 and the withdrawal chamber 80 can be sealed or releasably sealed together. For example, the melt chamber 30 can be sealed to the secondary chamber 50 and the secondary chamber 50 can be sealed to the withdrawal chamber 80. In various non-limiting embodiments, the seal between the melt chamber 30, the secondary chamber 50, and/or the withdrawal chamber 80 can be broken during the casting operation. For example, as described herein, the withdrawal chamber 80 can be moveably positioned relative to the secondary chamber 50 such that the withdrawal chamber 80 can move away from the secondary chamber 50 and break the seal therebetween (FIG. 7). In various non-limiting embodiments, the melt chamber 30, the secondary chamber 50, and the withdrawal chamber 80 can attain and/or maintain a uniform or substantially uniform pressure throughout. For example, the melt chamber 30, the secondary chamber 50, and the withdrawal chamber 80 can be sealed together and controlled to a desired melting pressure. In various non-limiting embodiments, at least two of the chambers 30, 50, 80 can be controlled to different pressures. For example, the pressure in the melt chamber 30, the secondary chamber 50, and the withdrawal chamber 80 can be adjusted during a continuous casting operation to provide a dynamic airlock that prevents infiltration of non-inert gas into the melt chamber 30 of the furnace 22. For example, the desired melting pressure can be a positive pressure. Initially, the melt chamber 30, the secondary chamber 50, and the withdrawal chamber 80 can be controlled to the positive, desired melting pressure. In various non-limiting embodiments, the pressure throughout the chambers 30, 50, 80 can be uniform or substantially uniform such that only slight or nominal pressure variations exist within the chambers 30, 50, 80. Subsequently, the withdrawal chamber 80 can open to the external atmosphere to attain atmospheric pressure, for example, and the melt chamber 30 can maintain the desired melting pressure therein. In such embodiments, the pressure throughout the secondary chamber 50 can be adjusted to form a dynamic airlock that prevents infiltration of the melt chamber 30 by the external atmosphere that is in the withdrawal chamber 80 and/or that is outside of the secondary chamber 50.

Referring still to FIG. 1, the continuous casting system 20 can include a pumping system that controls the pressure in the melt chamber 30, the secondary chamber 50, and/or the withdrawal chamber 80. The pumping system can evacuate the melt chamber 30, the secondary chamber 50, and the withdrawal chamber 80 to a vacuum, for example, and/or can adjust the pressure within the chambers 30, 50, 80 to various positive pressures, for example. In various non-limiting embodiments, the pumping system can control the melt chamber 30, the secondary chamber 50, and the withdrawal chamber 80 to the same pressure. Additionally or alternatively, the pumping system can control at least two of the chambers 30, 50, 80 to different pressures. Accordingly, the pumping system can include multiple pumps, gas sources, and/or gas bleeds to adjust the pressure in the various chambers 30, 50, 80. For example, the melt chamber 30 can comprise a melt chamber pumping system, the secondary chamber 50 can comprise a secondary chamber pumping system, and the withdrawal chamber 80 can comprise a withdrawal chamber pumping system. Each pumping system can include a gas source and bleed, i.e., a backfill system, for example. Furthermore, the secondary chamber pumping system can include differential pressure pumps 60. As described herein, the differential pressure pumps 60 can control the pressure in various regions 62 of the secondary chamber 50, for example. Furthermore, as described herein, the pumping system can form a closed loop or partially-closed loop system, such that at least a portion of the gas in the continuous casting system 20 can be recovered, purified, and recycled through the continuous casting system 20.

Figure 2:
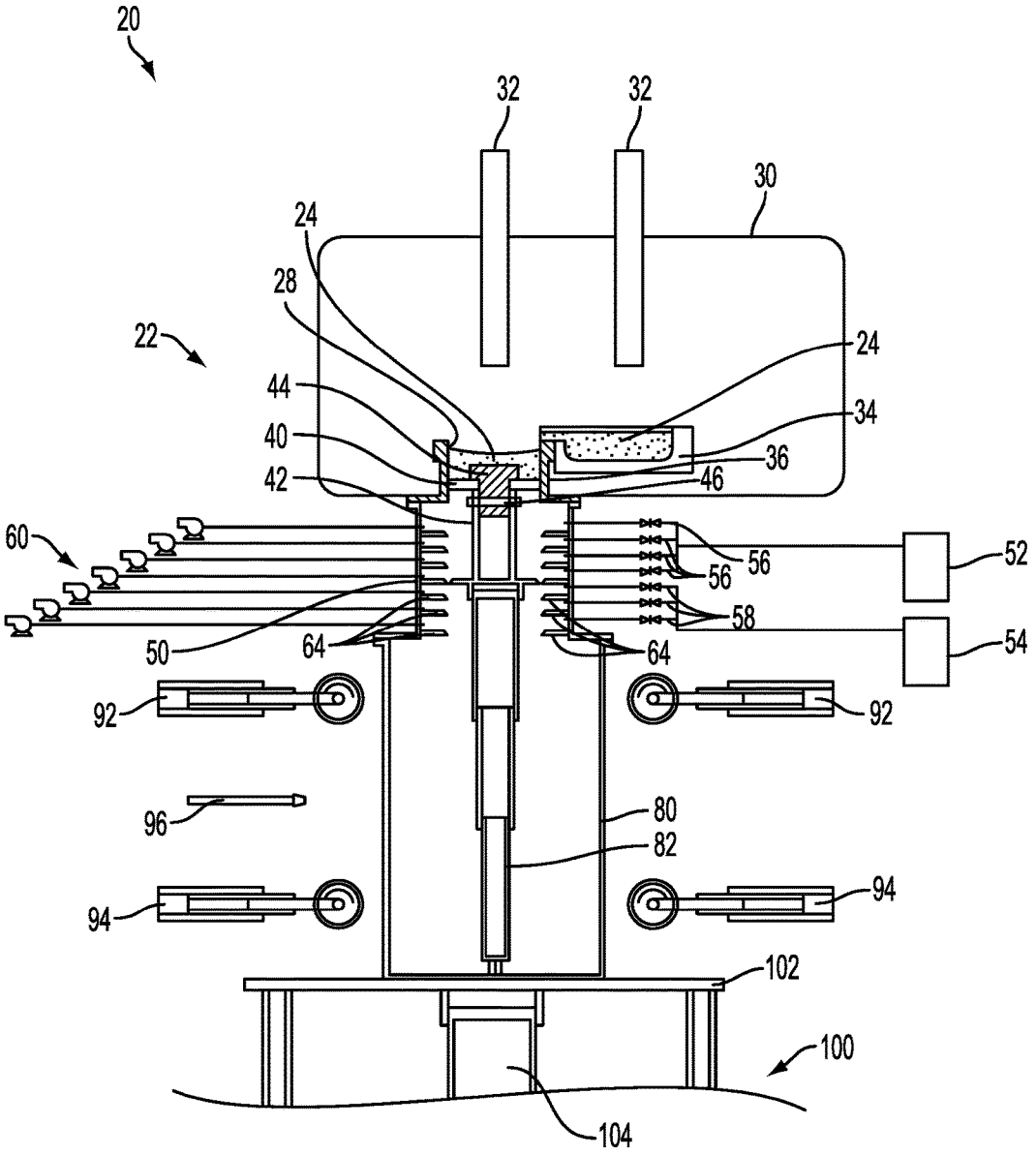
FIG. 2 is partial schematic of the continuous casting system of FIG. 1 showing molten material in the melt chamber.

Referring primarily to FIG. 2, the melt chamber 30 of the continuous casting system 20 can receive material 24 therein for melting and casting. An energy or heat source 32 of the furnace 22 can extend into the melt chamber 30 and can provide energy to the material 24 positioned therein. For example, the energy source 32 can produce a high intensity electron beam or a plasma arc across the surface of the material 24. In various non-limiting embodiments, the melt chamber 30 can include a vessel or hearth 34, such as a water-cooled, copper hearth, for example. Still referring primarily to FIG. 2, the hearth 34 can hold the material 24 while the heat source 32 applies energy to the material 24 positioned in the hearth 34 to melt the material 24.

Figure 3:
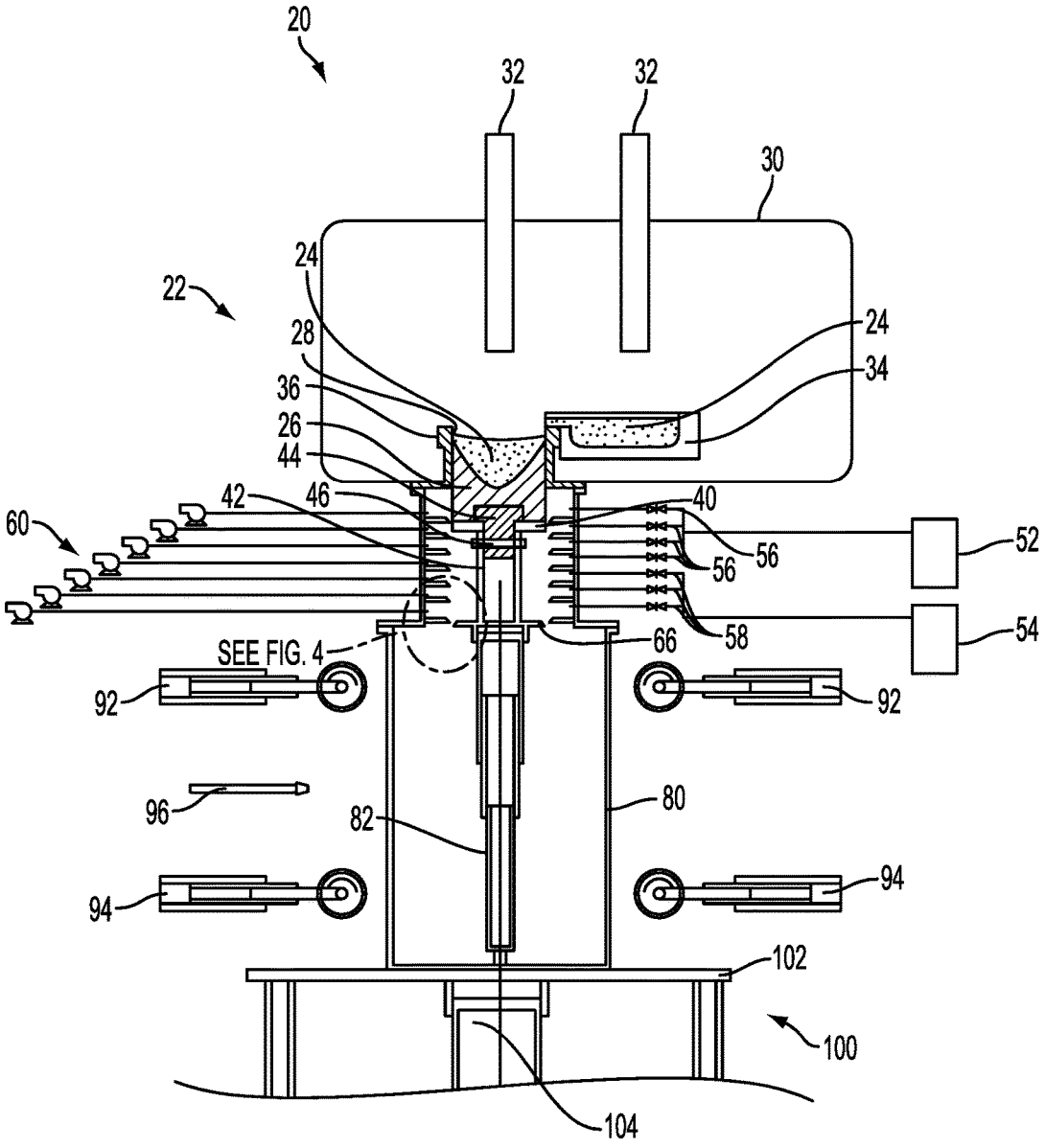
FIG. 3 is partial schematic of the continuous casting system of FIG. 1 showing a withdrawal ram drawing cast material through the secondary chamber.

In various non-limiting embodiments, the melt chamber 30 can include a crucible or mold 36. Molten material 24 can enter the mold 36, for example, and can exit the mold 36 as cast material 26, for example. Referring now to FIG. 3, the mold 36 can be an open-bottomed mold such that cast material 26 can exit the bottom of the mold 36 during the continuous casting operation. Further, the mold 36 can have an inner perimeter that corresponds to the intended shape of the cast material 26. A circular inner perimeter can produce a cylinder, for example, and a rectangular inner perimeter can produce a rectangular prism, for example. In various non-limiting embodiments, the mold 36 can have circular inner perimeter having a diameter of approximately 6 inches to approximately 32 inches, for example. Further, in various non-limiting embodiments, the mold 36 can have a rectangular inner perimeter that is approximately 36 inches by approximately 54 inches, for example. In various non-limiting embodiments, the mold 36 can be a water-cooled, copper mold. In some embodiments, the mold 36 can form a part of the outer perimeter of the melt chamber 30 and can be sealed to the melt chamber 30 and/or to the secondary chamber 50. For example, the mold 36 can form a sealed passageway between the melt chamber 30 and the secondary chamber 50.

Referring primarily to FIGS. 2 and 3, a dovetail plate 40 can be inserted into the mold 36 to form a moveable bottom surface therein. The dovetail plate 40 can be removed or withdrawn from the mold 36 and drawn through the melting furnace 22 during the continuous casting operation, for example. In at least one embodiment, the dovetail plate 40 can be a water-cooled, copper plate. In various non-limiting embodiments, the dovetail plate 40 can be connected to a withdrawal element 42, which can be connected to a withdrawal ram 82. The withdrawal ram 82 can include an extension and retraction mechanism such as a hydraulic cylinder or ball screw assembly, for example. In various non-limiting embodiments, the withdrawal ram 82 can pull the withdrawal element 42 and the attached dovetail plate 40 through the secondary chamber 50 and into the withdrawal chamber 80. In at least one embodiment, a starter block 44 can be inserted into the dovetail plate 40 and a locking pin 46 can releasably secure the starter block 44 to the dovetail plate 40. In various non-limiting embodiments, the starter block 44 can aid in the withdrawal of the dovetail plate 40 and the cast material 26 from the mold 36, as well as aid in the subsequent uncoupling of the end of the cast material 26 (FIG. 8) from the dovetail plate 40, as described in U.S. Pat. No. 6,273,179 to Geltzer, et al., the entire disclosure of which is incorporated by reference herein.

Referring again to FIG. 2, the energy source 32 can apply energy to material 24 positioned in the hearth 34 to melt the material 24. In various non-limiting embodiments, the molten material 24 can flow from the hearth 34 into the mold 36. In at least one embodiment, the hearth 34 can tilt or tip to pour the molten material 24 into the mold 36. In other embodiments, the molten material 24 may overflow out of the hearth 34 and into the mold 36. Referring still to FIG. 2, the molten material 24 can flow into the open-bottomed mold 36. In various non-limiting embodiments, when the molten material 24 flows into the mold 26, the molten material 24 can cover the dovetail plate 40 and/or the starter block 44, for example, and can contact the sides of the mold 36, for example.

In various non-limiting embodiments, the molten material 24 can comprise a material such as, for example, titanium (Ti), zirconium (Zr), magnesium (Mg), vanadium (V), niobium (Nb), and/or alloys of the same, which can be reactive at certain temperatures with gases present in the ambient atmosphere. For example, titanium can be reactive when molten and at elevated temperatures. To protect a reactive material during melting and casting, the atmosphere in the melt chamber 30, as well as other areas of the continuous casting system 20 where the material is substantially hot and thus reactive, can be controlled. For example, the pressure in the melt chamber 30 can be evacuated to a substantial vacuum and/or the melt chamber 30 can be filled with an inert gas. When the furnace 22 is an electron beam cold hearth melting furnace, the pressure of the melt chamber 30 can be approximately a vacuum, for example, and when the furnace 22 is a plasma arc cold hearth melting furnace the melt chamber 30 can be back-filled with an inert gas to a sub-atmospheric pressure or a positive pressure above atmospheric pressure, for example.

Referring again to FIGS. 2 and 3, the molten material 24 filling the mold 36 can form a molten seal 28 between the melt chamber 30 and the secondary chamber 50. In various non-limiting embodiments, molten material 24 can be adjacent to the side walls of a portion of the mold 36. For example, referring still to FIGS. 2 and 3, molten material 24 can abut the inner perimeter of the mold 36 along the top portion or surface of the material filling the mold 36. In various non-limiting embodiments, the molten seal 28 can provide a barrier that restricts and/or prevents the flow of gas that may otherwise enter the melt chamber 30 from the secondary chamber 50 and/or the external atmosphere and that could react with the molten material 24 therein. In various non-limiting embodiments, the cast material 26 can be solidified or substantially solidified upon exiting the mold 36. It will be understood that at least the outer, perimeter regions of the cast material 26 must be suitably solidified to maintain the integrity of the cast material 26 as it exits the mold 36. Referring primarily to FIG. 3, once the molten material 24 reaches a desired level in the mold 36, the dovetail plate 40 can be retracted through the open bottom of the mold 36 by the withdrawal ram 82. The withdrawal ram 82 can pull the withdrawal fixture 42, the dovetail plate 40, with the cast material 26 attached thereto, from the mold 36 and toward the secondary chamber 50. In various non-limiting embodiments, the rate of withdrawal of the cast material 26 from the mold 34 can match the rate that molten material 24 enters the mold 36 from the hearth 34 such that the level of molten material 24 in the mold 36 remains substantially the same during the continuous casting operation. For example, the rate of withdrawal of the cast material 26 can be approximately 100 lb/hour up to approximately 2000 lb/hour. In various non-limiting embodiments, the rate of withdrawal can be approximately 1500 lb/hour up to approximately 5000 lb/hour, for example. The rate of withdrawal can depend on the design of the melting furnace, the dimensions of the cast material 26, such as the cross section thereof, for example, and/or the properties of the cast and molten materials 24, 26, such as the density thereof, for example.

Figure 4:
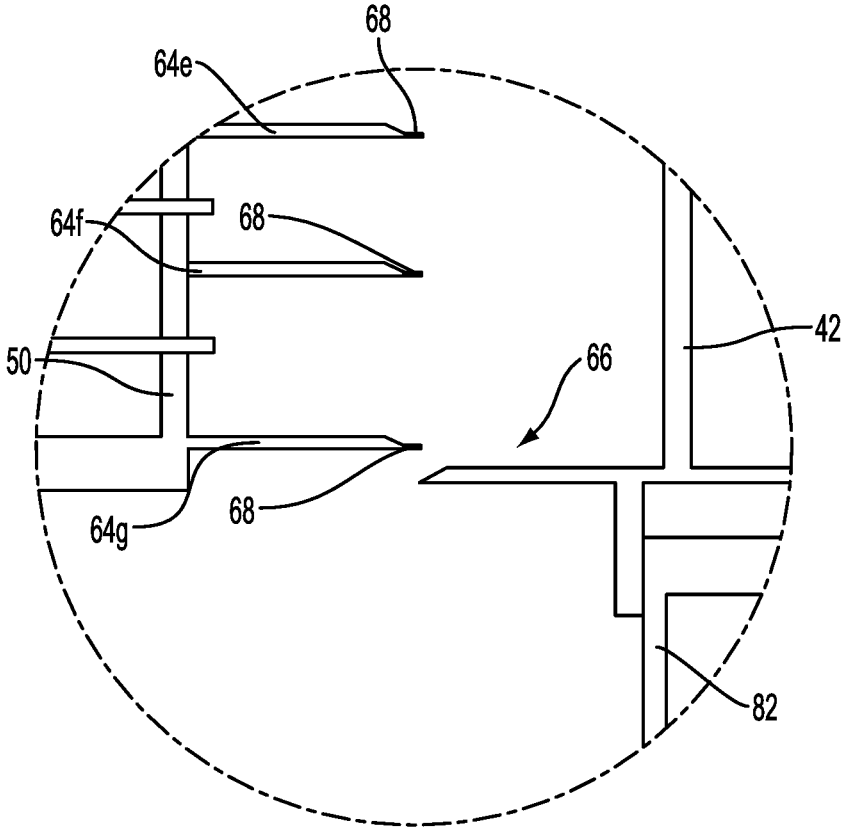
FIG. 4 is a detail view of the continuous casting system of FIG. 3 showing baffles of the secondary chamber.
Figure 5:
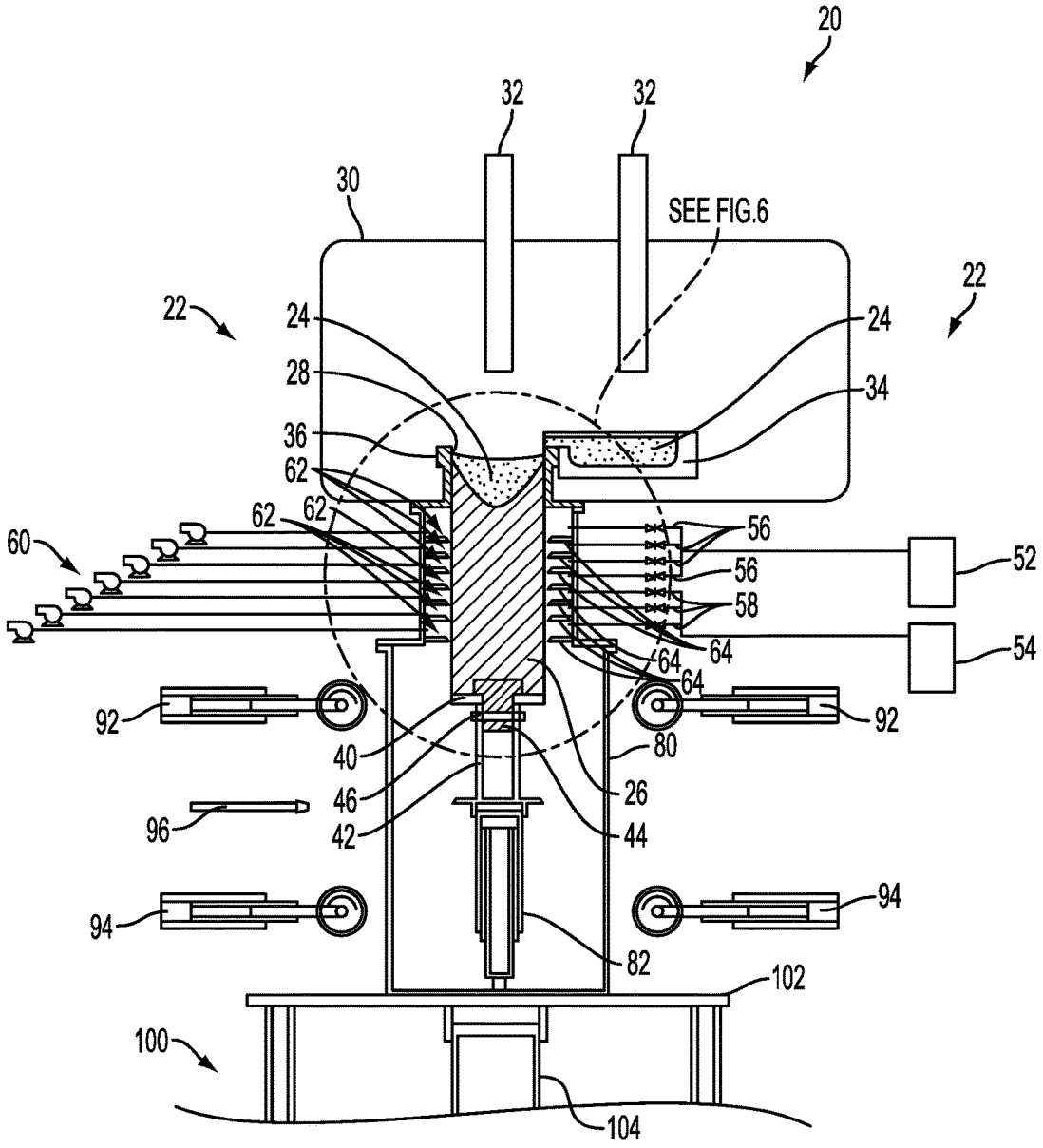
FIG. 5 is a partial schematic of the continuous casting system of FIG. 1 showing the withdrawal ram drawing cast material into the withdrawal chamber.
Figure 6:
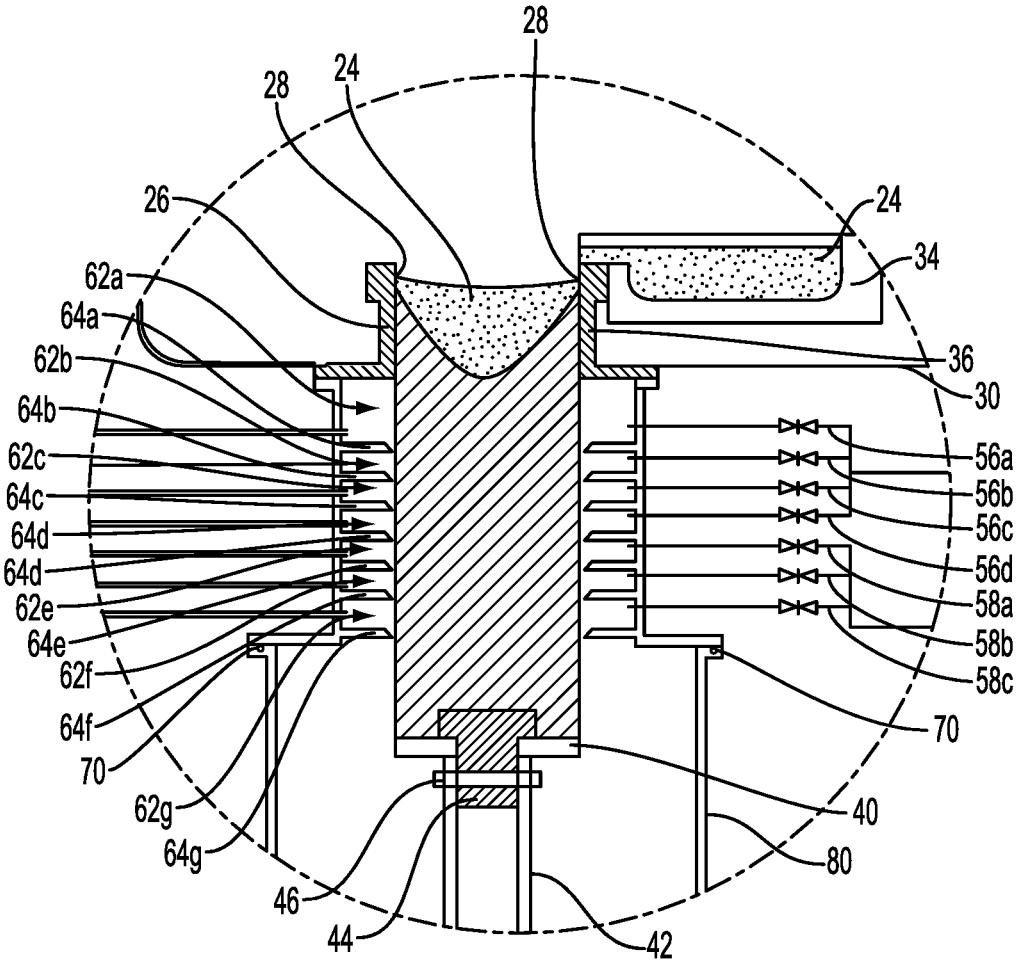
FIG. 6 is a detail view of the continuous casting system of FIG. 5 showing the differential pressure regions of the secondary chamber.

Referring primarily to FIGS. 4-6, the melt chamber 30 can be secured to the secondary chamber 50. For example, the melt chamber 30 can be clamped, bolted, fastened, or otherwise secured to the secondary chamber 50. In at least one embodiment, an o-ring or gasket, for example, can be positioned between the melt chamber 30 and the secondary chamber 50 to provide a vacuum-tight seal therebetween. In various non-limiting embodiments, the melt chamber 30 and the secondary chamber 50 can be releasably secured together such that the mold 36 positioned therebetween can be removed, replaced, and/or interchanged with another mold. In various non-limiting embodiments, as described herein, the mold 36 can form a sealed passageway between the melt chamber 30 and the secondary chamber 50. Further, the secondary chamber 50 can be positioned adjacent to and/or under the melt chamber 30, for example. In various non-limiting embodiments, the secondary chamber 50 can form a dynamic seal or airlock between the melt chamber 30, which can be operably controlled to the desired melting pressure, for example, and the withdrawal chamber 80, which can be operably controlled to atmospheric pressure, for example. In some embodiments, the secondary chamber 50 can include a cooling system (not shown). The walls of the secondary chamber 50 can include channels, for example, such that water and/or other cooling liquids can be pumped through the channels to prevent the overheating of the secondary chamber 50 by the cast material 26 and to continue to cool the cast material 26 in the secondary chamber 50.

Referring still to FIGS. 4-6, the secondary chamber 50 can include at least one pressure management element 64 that controls the flow of gas between adjacent regions 62 of the plurality of regions. For example, the pressure management elements 64 may be adapted to maintain a desired pressure in each region 62 of the secondary chamber 50. In some embodiments, the secondary chamber 50 can include a series of pressure management elements 64, for example. A pressure management element 64 can be a baffle or a diaphragm wall, as described in, for example, U.S. Pat. No. 3,888,300 to Guichard et al., the entire disclosure of which is incorporated by reference herein. In various non-limiting embodiments, the pressure management elements 64 can extend from the inner perimeter of the secondary chamber 50 toward the center of the secondary chamber 50, for example. In at least one embodiment, the pressure management elements 64 can include an aperture 66, which can be positioned at or near the center of the pressure management element 64, for example. The apertures 66 can be structured to receive the cast material 26 therethrough as the cast material 26 is withdrawn through the secondary chamber 50. When the secondary chamber 50 is cylindrical, for example, and the cast material 26 is cylindrical, for example, the pressure management elements 64 can be circular disks with a circular aperture therethrough. In various non-limiting embodiments, the apertures 66 through the pressure management elements 64 can be sized to restrict the flow of gas and limit the shifting of pressure between adjacent regions 62 of the secondary chamber 50 when the cast material 26 is positioned through the adjacent regions 62. Furthermore, roller assemblies (not shown) may be positioned within the secondary chamber 50 and/or between pressure management elements 64 to support the cast material 26 extending therethrough, as described in U.S. Pat. No. 3,888,300 to Guichard et al., the entire disclosure of which is incorporated by reference herein.

Referring primarily to FIG. 6, when the cast material 26 extends through regions 62 of the secondary chamber 50, the pressure management elements 64 can extend from the inner perimeter of the secondary chamber 50 toward the cast material 26, for example. In various non-limiting embodiments, pressure management element(s) 64, the inner perimeter of the secondary chamber 50, and the cast material 26 can define the boundaries of a region 62 in the secondary chamber 50. For example, a third differential pressure region 62*c* in the secondary chamber 50 can be bordered by a second pressure management element 64*b*, a third pressure management element 64*c*, the inner perimeter of the secondary chamber 50, and the cast material 26. In various non-limiting embodiments, a region 62 may also be bounded by another surface in one of the chambers 30, 50, 80. For example, the first differential pressure region 62*a* can be bounded by a surface of the mold 36, a first pressure management element 64*a*, the inner surface of the secondary chamber 50, and the cast material 26. In various non-limiting embodiments, the aperture 66 through each pressure management element 64 can provide enough space for the cast material 26 to fit through the pressure management element 64 without contacting the pressure management element 64. The apertures 66 can be only slightly larger than the cross-section of the mold 36, for example, such that the distance between the pressure management element 64 and the cast material 26 extending therethrough is minimized. In at least one embodiment, the distance between the cast material 26 and the pressure management element 64 can be approximately 2 mm to approximately 5 mm, for example. In other embodiments, the distance between the cast material 26 and the pressure management element 64 can be less than approximately 2 mm, for example.

In various non-limiting embodiments, the pressure management elements 64 can be metal such as, for example, stainless steel. The pressure management elements 64 can include an internal channel (not shown) through which water and/or other cooling liquids can be pumped to cool the furnace 22, as described in, for example, U.S. Pat. No. 3,888,300 to Guichard et al., the entire disclosure of which is incorporated by reference herein. In at least one embodiment, the channels in the pressure management elements 64 can connect to the channels in the chamber walls such that water and/or other cooling liquids can circulate through the chamber walls and through the pressure management elements 64 extending therefrom. In various non-limiting embodiments, referring primarily to FIG. 4, the pressure management elements 64 can include brushes 68. The brushes 68 can extend from the internal perimeter of the pressure management elements 64 towards the cast material 26 and can further reduce the space between the pressure management elements 64 and the cast material 26. The brushes 68 can be metal such as, for example, stainless steel. In various non-limiting embodiments, the brushes 68 can be sufficiently flexible such that contact between the cast material 26 and the brushes 68 will not damage the pressure management elements 64. Furthermore, in various non-limiting embodiments, contact between the cast material 26 and the brushes 68 will not contaminate the cast material 26.

Referring primarily to FIGS. 5 and 6, the pressure management elements 64 can extend between adjacent differential pressure regions 62 in the secondary chamber 50. For example, a first pressure management element 64*a* can extend between the first differential pressure region 62*a* and the second differential pressure region 62*b*, a second pressure management element 64*b* can extend between the second differential pressure region 64*b* and the third differential pressure region 62*b*, a third pressure management element 64*c* can extend between the third differential pressure region 62*c* and the fourth differential pressure region 62*d*, and etc. In various non-limiting embodiments, the first differential pressure region 62*a* can be adjacent to and/or directly below the melt chamber 20. Furthermore, the second differential pressure region 62*b* can be adjacent to and/or directly below the first differential pressure region 62*a*, for example. In various non-limiting embodiments, a final or terminal differential pressure region 64*g* can be adjacent to and/or directly above the withdrawal chamber 80. Furthermore, in at least one embodiment, an intermediate differential pressure region 62*d* can be positioned between the second differential pressure region 62*b* and the final differential pressure region 62*g*, for example. In certain non-limiting embodiments, at least one additional differential pressure region 62*c* can be positioned between the second differential pressure region 62*b* and the intermediate differential pressure region 62*d*, for example, and/or at least one additional differential pressure region 62*e*, 62*f* can be positioned between the intermediate differential pressure region 62*d* and the final differential pressure region 62*g*, for example.

Referring still to FIGS. 5 and 6, the secondary chamber 50 can include seven differential pressure regions 62*a*, 62*b*, 62*c*, 62*d*, 62*e*, 62*f*, 62*g*, for example, and seven pressure management elements 64*a*, 64*b*, 64*c*, 64*d*, 64*e*, 64*f*, 64*g*, for example. The number of regions 62 and corresponding pressure management elements 64 in the secondary chamber 50 can at least depend on the properties of the molten and cast material 24, 26 and/or the pressure difference between the desired melting pressure and atmospheric pressure, for example.

In various non-limiting embodiments, referring primarily to FIG. 5, the differential pressure pumps 60 can adjust the pressure in each differential pressure region 62 of the secondary chamber 50. For example, the differential pressure pumps 60 can extract gas from the regions 62. In at least one embodiment, the pumps 60 can operably evacuate the regions 62 to a vacuum or a substantial vacuum. Furthermore, a gas source 52, 54 and a corresponding gas bleed 56, 58 can pump gas into a region 62 to increase the pressure therein. In various non-limiting embodiments, a first plurality of gas bleeds 56*a*, 56*b*, 56*c*, 56*d* can extend from the first gas source 52, and a second plurality of gas bleeds 58*a*, 58*b*, 58*c* can extend from the second gas source 54. The gas bleeds 56, 58 can introduce, for example, approximately 1 SCFM to approximately 25 SCFM of gas into the respective regions 62. The first gas source 52 can hold a first gas or first combination of gases, for example, and the second gas source 54 can hold a second gas or second combination of gases, for example. As described herein, in various non-limiting embodiments, at least one gas source 52, 54 can hold an inert gas or combination of inert gases, for example. In various non-limiting embodiments, the gas source 52, 54 can distribute gas to multiple gas bleeds 56, 58. Furthermore, the differential pressure pumps 60, gas sources 52, 54, and gas bleeds 56, 58 can control the pressure in the differential pressure regions 62 of the secondary chamber 50 such that the secondary chamber 50 forms a dynamic airlock between the melt chamber 30 and the withdrawal chamber 80.

In various non-limiting embodiments, the differential pressure pumps 60 may initially evacuate the regions 62 to a vacuum or a substantial vacuum and, subsequently, the gas bleeds 56, 58 may introduce gas into the regions 62 to achieve a pressure that is equal to or substantially equal to the desired melting pressure. For example, the regions 62 can be evacuated to a substantial vacuum of approximately 100 mTorr to approximately 10 mTorr, for example. Subsequently, the gas bleeds 56, 58 can introduce gas to attain the desired melting pressure of approximately 400 Torr to approximately 1000 Torr, for example. In various non-limiting embodiments, the pumping system can control the pressure to the desired melting pressure ±25 Torr throughout the secondary chamber 50, for example. The presence of gas in the secondary chamber 50 can improve the transfer of heat from the cast material 26, which can increase the solidification rate of the cast material 26. In other words, the cast material 26 can cool and thus solidify quicker when the secondary chamber 50 is filled with an inert gas than when the secondary chamber 50 maintains a vacuum or substantial vacuum, for example.

Referring to FIGS. 5 and 6, when the cast material 26 is positioned through a region 62 of the secondary chamber 50, the cast material 26, the baffles 64, and the inner perimeter of the secondary chamber 50 can define the boundaries of the region 62 in which a desired pressure can be attained and/or maintained, for example. Once the boundaries of a region 62 are defined, the differential pressure pumps 60, gas sources 52, 54, and/or gas bleeds 56, 58 can adjust the pressure in the region 62 of the secondary chamber 50. In various non-limiting embodiments, the differential pressure pumps 60 can control the pressure in various regions 62 of the secondary chamber 50 to different pressures. For example, in certain non-limiting embodiments the pressure in the first differential pressure region 62*a* of the secondary chamber 50 can be increased to at least slightly above the desired melting pressure. For example, the pressure in the first differential pressure region 62*a* can be controlled to approximately 880 Torr to approximately 930 Torr when the desired melting pressure is approximately 825 Torr to approximately 875 Torr. In other words, the difference in pressure between the melt chamber 30 and the first differential pressure region 62*a* can be approximately 10 Torr to approximately 50 Torr, for example. Additionally, in certain non-limiting embodiments pressure in the second differential pressure region 62*b* can be controlled to slightly less than the pressure in the first differential pressure region 62*a*. For example, the pressure in the second differential pressure region 62*b* can be controlled to approximately 825 Torr to approximately 850 Torr. In various non-limiting embodiments, the difference in pressure between the first differential pressure 62*a* region and the second differential pressure region 62*b* can be approximately 10 Torr to approximately 50 Torr. Accordingly, in certain non-limiting embodiments the first differential pressure region 62*a* can be a high pressure region that separates the melt chamber 50 from the subsequent regions 62*b*, 62*c*, etc. in the secondary chamber 50 and that prevents infiltration of the melt chamber 30 by non-inert gas in the external atmosphere.

Referring still to FIGS. 5 and 6, the pressure in subsequent regions 62*c* of the secondary chamber 50 between the second differential pressure region 62*b* and the intermediate differential pressure region 62*d* can be incrementally decreased, for example. In various non-limiting embodiments, the pressure can be incrementally decreased by approximately 10 Torr to approximately 100 Torr between adjacent regions 62, for example. The number and size of the regions 62 and pressure management elements 64 between the second differential pressure region 62*b* and the intermediate differential pressure region 62*d* can vary. In at least one embodiment, the number of additional regions 62 can depend on the material properties of the molten material 24 and the cast material 26, as well as the pressure within the melt chamber 30 and the withdrawal chamber 80. In various non-limiting embodiments, the number of additional regions 62 can depend on the rate of heat transfer from the cast material 26. For example, at least one region 62 can be positioned between the second differential pressure region 62*b* and the intermediate pressure region 62*d*. In certain non-limiting embodiments, two to five regions 62 can be positioned between the second differential pressure region 62*b* and the intermediate pressure region 62*d*. In various non-limiting embodiments, more than five regions 62 can be positioned between the second differential pressure region 62*b* and the intermediate pressure region 62*d*, for example.

A sufficient number of regions 62 may be positioned between the melt chamber 30 and the intermediate region 62*d* of the secondary chamber 50 such that the cast material 26 is sufficiently cooled upon reaching the intermediate region 62*d*. The cast material 26 may be cooled to such a degree that exposure to the external atmosphere in the withdrawal chamber will not cause contamination. For example, a cast titanium alloy may be cooled to approximately <1000-1200° F. when the cast titanium 26 reaches the intermediate differential pressure region 62*d* to avoid reactivity and contamination of the cast titanium 26 by a non-inert gas in the lower regions 62*e*, 62*f*, 62*g* of the secondary chamber 50 and in the external atmosphere.

Still referring primarily to FIGS. 5 and 6, the pressure in the intermediate differential pressure region 62*d* can be controlled to less than the pressure in the adjacent regions of the secondary chamber 50. For example, the pressure in the regions directly above and directly below the intermediate differential pressure region 62*d* can be greater than the pressure in the intermediate differential pressure region 62*d*. In other words, the intermediate differential pressure region 62*d* can be a low pressure region between the first differential pressure region 62*a* and the final differential pressure region 62*g*. In certain non-limiting embodiments, the pressure in the intermediate differential pressure region 62*d* can be approximately 250 Torr to approximately 300 Torr, for example. In various non-limiting embodiments, the pressure in the intermediate differential pressure region 62*d* can be approximately 100 Torr to approximately 400 Torr, for example.

Referring still to the embodiment illustrated in FIGS. 5 and 6, the pressure in subsequent regions 62*e*, 62*f* of the secondary chamber 50 between the intermediate differential pressure region 62*d* and the final differential pressure region 62*g* can be incrementally increased. In various non-limiting embodiments, the pressure may be incrementally increased by approximately 10 Torr to approximately 100 Torr between adjacent regions 62, for example. The number and size of regions 62 and pressure management elements 64 between the intermediate differential pressure region 62*d* and the final differential pressure region 62*g* can vary. In at least one embodiment, the number of additional regions 62 can depend on the material properties of the molten material 24 and the cast material 26, as well as the pressure within the melt chamber 30 and the withdrawal chamber 80. In various non-limiting embodiments, the number of additional regions 62 can be sufficient to gradually increase the pressure in the final differential pressure region 62*g* to slightly greater than atmospheric pressure. For example, at least one region 62 can be positioned between the intermediate differential pressure region 62*d* and the final pressure region 62*g*. In certain non-limiting embodiments, two to five regions 62 can be positioned between the intermediate differential pressure region 62*d* and the final pressure region 62*g*. In various non-limiting embodiments, more than five regions 62 can be positioned between the intermediate differential pressure region 62*d* and the final differential pressure region.

The final differential pressure region 62*g* can be adjacent to and/or above the withdrawal chamber 80. In various non-limiting embodiments, the final differential pressure region 62*g* can attain a pressure that is at least slightly greater than atmospheric pressure. For example, in certain non-limiting embodiments, the pressure in the final differential pressure region 62*g* can be approximately 740 Torr to approximately 850 Torr and/or the difference between the pressure in the final differential pressure region 62*g* and atmospheric pressure can be approximately 10 Torr to approximately 100 Torr, for example. In other words, the final differential pressure region 62*g* can be a second high pressure region in the secondary chamber 50.

As described herein, the molten seal 28 provides a seal between the melt chamber 30 and the withdrawal chamber 80. If the molten seal 28 is broken, however, the dynamic airlock of the secondary chamber 50 can provide a secondary seal to prevent contamination of the melt chamber 30. Additionally, the secondary chamber 50 can prevent contamination of cast material 26 positioned in the secondary chamber 50 that is still at a temperature at which the cast material 26 is reactive to non-inert gases. The first differential pressure region 62*a* can prevent contamination because gas is directed away from the first differential pressure region 62*a*, i.e., a relatively high pressure region, toward the intermediate differential pressure region 62*d*, i.e., a relatively low pressure region. In other words, gas is directed away from the melt chamber 30 and toward the intermediate region 62*d* of the secondary chamber 50. Furthermore, the first differential pressure region 62*a* can decrease pressure fluctuations in the melt chamber 30 because gas in the melt chamber 30 will not seek to escape the melt chamber 30 for the secondary chamber 50 if the molten seal 28 breaks. Conversely, if the molten seal 28 breaks and the melt chamber 30 were operated at a positive pressure and the first differential pressure region 62*a* were operated at a vacuum or lower positive pressure, for example, gas would seek to escape the melt chamber 30 for the secondary chamber 50, thus creating a pressure fluctuation in the melt chamber 30.

Furthermore, the final differential pressure region 62*g* can prevent contamination of the melt chamber 30 because non-inert gas outside of the secondary chamber 50 and/or in the withdrawal chamber 80 is directed away from the final differential pressure region 62*g*, i.e., a high pressure region, toward the external atmosphere, i.e., a lower pressure region. In other words, non-inert gas in the external atmosphere will not seek to flow from the external atmosphere into the final differential pressure region 62*g* of the secondary chamber 50 because the final differential pressure region 62*g* is a high pressure region. Furthermore, the decreasing pressures from the final differential pressure region 62*g* to the intermediate differential pressure region 62*d* will direct a flow of gas toward the intermediate differential pressure region 62*d* rather than toward the final differential pressure region 62*d*.

Referring again to FIG. 6, the first gas source 52 can hold a first gas or first combination of gases, for example, and the second gas source 54 can hold a second gas or second combination of gases, for example. Furthermore, in various non-limiting embodiments, at least the first gas or first combination of gases can be an inert gas or combination of inert gases such as helium and/or argon, for example. The first gas source 52 can supply gas to the regions 62 in the secondary chamber 50 from the first differential pressure region 62*a*, or first high pressure region, through the intermediate differential pressure region 62*d*, or low pressure region. In other words, the first gas source 52 can be connected to the regions 62 of incrementally decreasing pressure from the first high pressure region 62*a* adjacent to the melt chamber 30 through the low pressure region or intermediate differential pressure region 62*d*. The presence of inert gas in the regions 62 adjacent to the melt chamber 30 can ensure that, if the molten seal 28 breaks, inert gas, rather than non-inert gas, can enter the melt chamber 30, and thus, contamination of molten material 24 in the melt chamber 30 can be substantially prevented. The differential pressure pumps 60 and the gas bleeds 56 can draw inert gas from and/or introduce inert gas into those regions 62 to adjust the pressure therein. As described herein, before the cast material 26 exits the intermediate differential pressure region 62*d*, the cast material 26 may be sufficiently cooled such that it is non-reactive to non-inert gases. However, the cast material 26 can be sufficiently hot and reactive between the first differential pressure region 62*a* and the intermediate differential pressure region 62*d*. Accordingly, the first gas source 52, which supplies gas to differential pressure regions 62*a*, 62*b*, 62*c*, 62*d*, for example, should supply inert gas to avoid contamination of the potentially reactive cast material 26 extending therethrough.

Still referring primarily to FIG. 6, the second gas source 54 can supply gas to regions 62 in the secondary chamber 50 that are positioned after the intermediate differential pressure region 62*d* and through the final differential pressure region 62*g* or second high pressure region. Non-inert gas or gases, such as compressed air, for example, can be supplied by the second gas source 54 without risking contamination of the cast material 26 positioned therein. For example, the cast material 26 can be sufficiently cooled when it passes out of the intermediate region 62*d* such that it is non-reactive to non-inert gases. In alternative embodiments, the second gas source 54 can include or consist essentially of inert gases, as well.

In various non-limiting embodiments, the differential pressure pumps 60 can be connected to a gas recovery system (not shown). Inert gas used in the continuous casting system 20 can be expensive, and thus the gas recovery system can seek to recover and recycle the inert gas for future uses. For example, the gas recovery system can pump gas from regions 62 of the secondary chamber 50, compress the withdrawn gas, process the gas through a purification system, and return the gas to the gas source 52, 54. In other words, the gas can be recycled through the system. In various non-limiting embodiments, the purification system of the gas recovery system can be external to the melting furnace 22. In some embodiments, where inert gas is supplied by the first gas source 52 to the upper regions 62*a*, 62*b*, 62*c*, 62*d* of the secondary chamber 50, for example, and when non-inert gas is supplied by the second gas source 54 to the lower regions 62*e*, 62*f*, 62*g* of the secondary chamber 50, for example, the incrementally decreasing pressure from the first differential pressure region 62*a* to the intermediate differential pressure region 62*d* can allow for recovery of the inert gas used in those regions 62*a*, 62*b*, 62*c*, 62*d*, for example. In at least one embodiment, a small volume of non-inert gas may flow to the intermediate differential pressure region 62*d*, which is controlled to a lower pressure during the continuous casting operations, from an adjacent, lower region 62*e*. In various non-limiting embodiments, the volume of gas flow between adjacent regions 62 can be minimized. For example, the volume of gas flow can depend on the space between the cast material 26 and the pressure management element 64, as well as the pressure differential between adjacent regions 62. In various non-limiting embodiments, the intermediate differential pressure pump 64*d* that corresponds to the intermediate differential pressure region 62*d* can withdraw the gas from the intermediate differential pressure region 62*d*. During the recovery process, the small volume of non-inert gas withdrawn by the pump 64*d*, for example, can be removed before the gas is returned to the first gas source 52 such that the inert gas can be recycled through the continuous casting system 20 in chambers and/or regions where the material 24, 26 is reactive. Conversely, if the pressure in the secondary chamber 50 was increased to atmospheric pressure after the first differential pressure region 62*a* rather than incrementally decreased to a low pressure region 62*d*, then inert gas in the first differential pressure region 62*a* may escape to the external atmosphere, for example.

In various non-limiting embodiments, referring primarily to FIGS. 6 and 7, the withdrawal chamber 80 can be positioned adjacent to the secondary chamber 50. In some embodiments, the withdrawal chamber 80 can be moveably positioned relative to the secondary chamber 50. When the withdrawal chamber 80 is positioned adjacent to the secondary chamber 50, the secondary chamber 50 and the withdrawal chamber 80 can be sealed together. An o-ring or gasket 70 (FIG. 6) can be positioned between the withdrawal chamber 80 and the secondary chamber 50 to provide a vacuum-tight seal therebetween, for example. Additionally or alternatively, a hydraulically-driven lock (not shown) can seal the withdrawal chamber 80 to the secondary chamber 50, for example. In various non-limiting embodiments, the withdrawal chamber 80 can be controlled to the same pressure as the melt chamber 30, i.e., to the desired melting pressure. As described herein, the withdrawal chamber 80 can operably attain atmospheric pressure during the continuous casting operations, and the secondary chamber 50 can provide a dynamic airlock between the melt chamber 30, which can be maintained at the desired melting pressure, and the withdrawal chamber 80.

Figure 8:
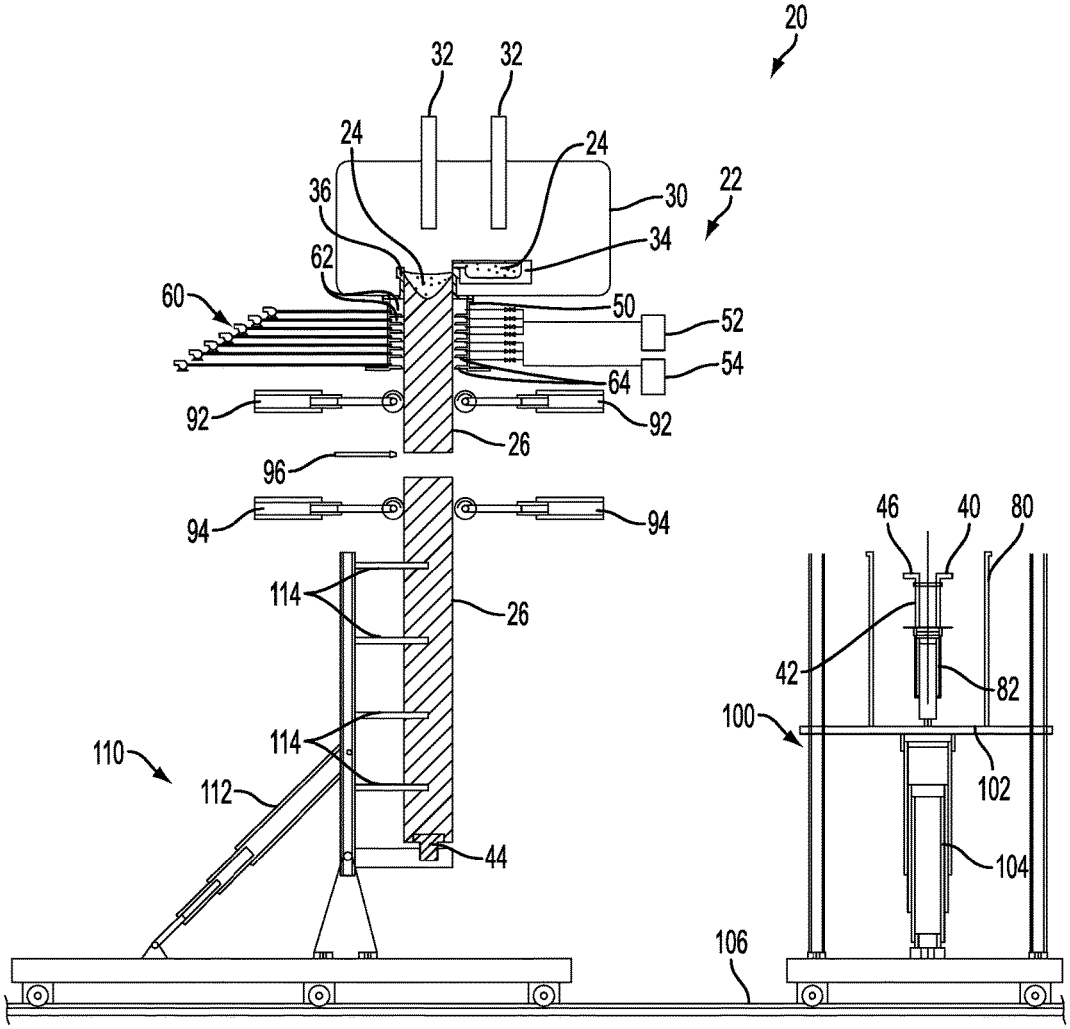
FIG. 8 is a schematic of the continuous casting system of FIG. 1 showing the withdrawal chamber and withdrawal cart removed from the furnace and an unloading device unloading a cut segment of cast material.

Referring primarily to FIG. 1, a release or withdrawal cart 100 can be positioned adjacent to and/or below the withdrawal chamber 80. The withdrawal cart can include a platform 102, which can support the withdrawal chamber 80, for example. In some embodiments, operation of the withdrawal cart 100 can raise and/or lower the withdrawal chamber 80. For example, the withdrawal cart 100 can include a second withdrawal ram 104, which can operably move the withdrawal platform 102 upward and downward relative to the secondary chamber 50. In various non-limiting embodiments, the withdrawal ram 104 can draw the withdrawal platform 102 downward to release the withdrawal chamber 80 from the secondary chamber 50. Release of the withdrawal chamber 80 can open the withdrawal chamber 80 to the external atmosphere. In other words, the seal between the withdrawal chamber 80 and the secondary chamber 50 can break when the withdrawal chamber 80 is disconnected or moved away from the secondary chamber 50. However, even when the withdrawal chamber 80 opens to the external atmosphere and attains atmospheric pressure, the molten material 24 in the melt chamber 30 can remain protected from non-inert gas in the atmosphere by the molten seal 28 and the dynamic airlock of the secondary chamber 50, described herein. Referring to FIGS. 1 and 8, the withdrawal cart 100 can be positioned on a guide track or rail 106. The withdrawal cart 100 can include wheels, for example, and can roll along the track or tracks 106 between an operating position (FIG. 1) and a staging position (FIG. 8). In various non-limiting embodiments, once the second withdrawal ram 104 collapses to withdraw the platform 102 and lower the withdrawal chamber 80, the withdraw cart 100 can move to the staging position.

Referring again to FIG. 7, the continuous casting system 20 can include a primary set of rollers 92. In various non-limiting embodiments, the primary set of rollers 92 can be configured to move between a retracted position (FIG. 5) and an extended position (FIG. 7). For example, the primary set of rollers 92 can extend toward the cast material 26 such that the primary set of rollers 92 can contact the cast material 26 when the primary set of rollers are in the extended position. In various non-limiting embodiments, the primary set of rollers 92 can contact the cast material 26 after the withdrawal chamber 80 has been retracted and/or released from the secondary chamber 50. For example, the primary set of rollers 92 may be blocked by the withdrawal chamber 80, such that the primary set of rollers 92 are prevented from extending to the cast material 26 prior to retraction of the withdrawal chamber 80. In certain non-limiting embodiments, the primary set of rollers 92 can help to control the withdrawal speed of the cast material 26. In other words, the rate of rotation of the primary set of rollers 92 can affect the speed at which the cast material 26 exits the mold 36.

Referring now to FIG. 8, the continuous casting system 20 can include a secondary set of rollers 94. In various non-limiting embodiments, the secondary set of rollers 94 can be configured to move between a retracted position (FIG. 5) and an extended position (FIG. 8). For example, the secondary set of rollers 94 can extend toward the cast material 26 such that the rollers of the secondary set of rollers 94 contact the cast material 26 when the secondary rollers 94 are in the extended position. In various non-limiting embodiments, the secondary set of rollers 94 can contact the cast material 26 after the withdrawal chamber 80 has been retracted and/or released from the secondary chamber 50. For example, the secondary set of rollers 94 may be blocked by the withdrawal chamber 80, such that the secondary set of rollers 94 are prevented from extending to the cast material 26 prior to retraction of the withdrawal chamber 80. In some embodiments, the secondary set of rollers 94 can help to control the withdrawal speed of the cast material 26. In other words, in certain non-limiting embodiments the rate of rotation of the secondary set of rollers 92 can affect the speed at which the cast material 26 exits the secondary chamber 50. Further, the secondary set of rollers 94 can direct the cast material 26 onto an unloading device, as described herein. In various non-limiting embodiments, still referring primarily to FIG. 8, a cutting device 96 can cut the cast material 26 after the cast material 26 has been drawn through the secondary chamber 50. The cutting device 96 can cut the cast material 26 below the primary set of rollers 92, for example, and/or above the secondary set of rollers 94, for example.

Figure 9:
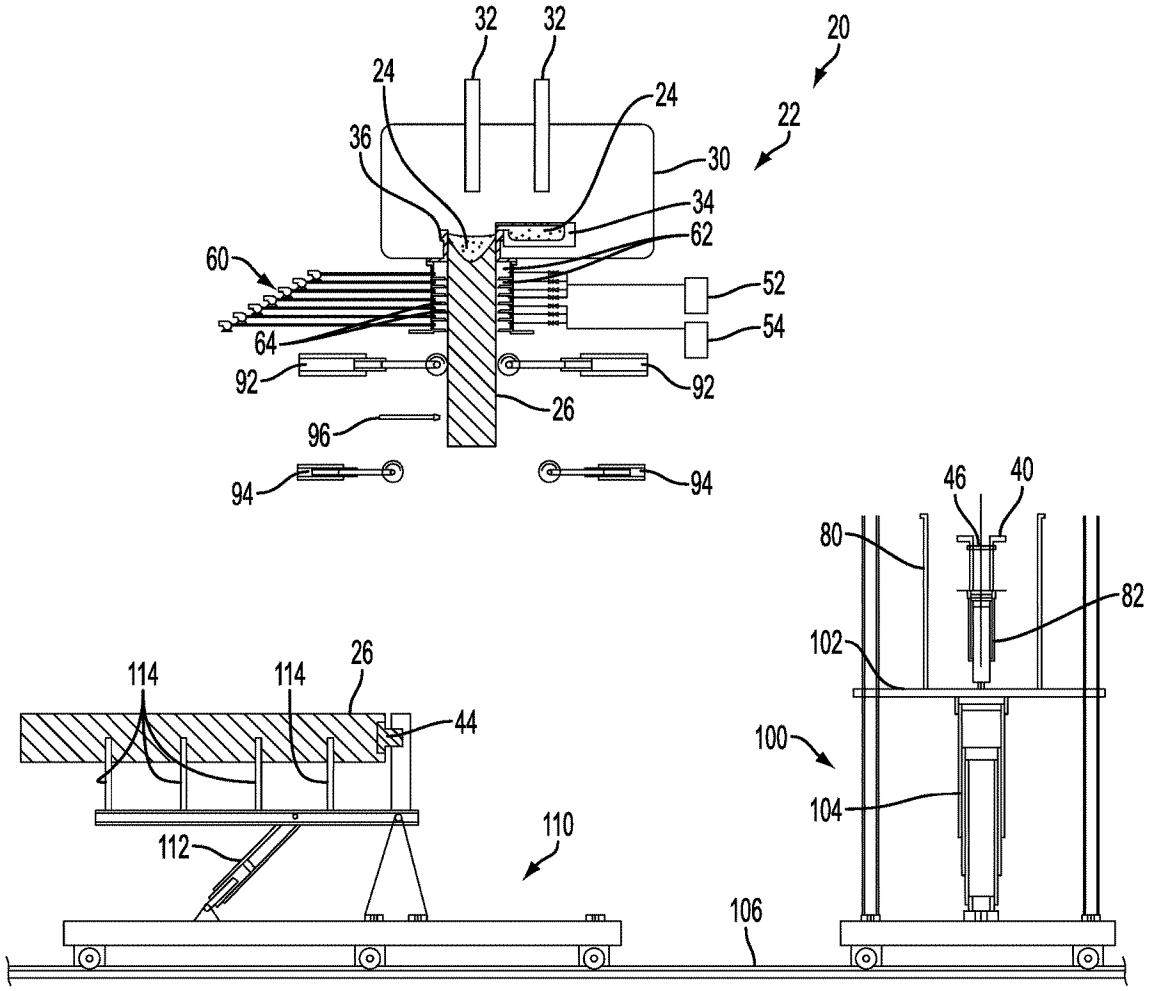
FIG. 9 is a schematic of the continuous casting system of FIG. 8 showing the unloading device removing the cut segment of cast material.

Referring now to FIGS. 8 and 9, in certain non-limiting embodiments a first unloading device 110 can include a telescoping support mechanism 112 and/or grippers 114. The grippers 114 can secure or grip the cast material 26 below the first and/or second set of rollers 92, 94, for example. Further, in various non-limiting embodiments, the telescoping support mechanism 112 can hold the grippers 114. In at least one embodiment, the telescoping support mechanism 112 can collapse or partially collapse to lower the cast material 26 held by the grippers 114. The telescoping support mechanism 112 can collapse to move the cast material 26 from a vertical configuration (FIG. 8) to a horizontal configuration (FIG. 9), for example. Referring primarily to FIG. 9, the first unloading device 110 can move or roll along the guide tracks 106 to move the cut segment of cast material 26 away from the continuous casting system 20, for example.

Figure 10:
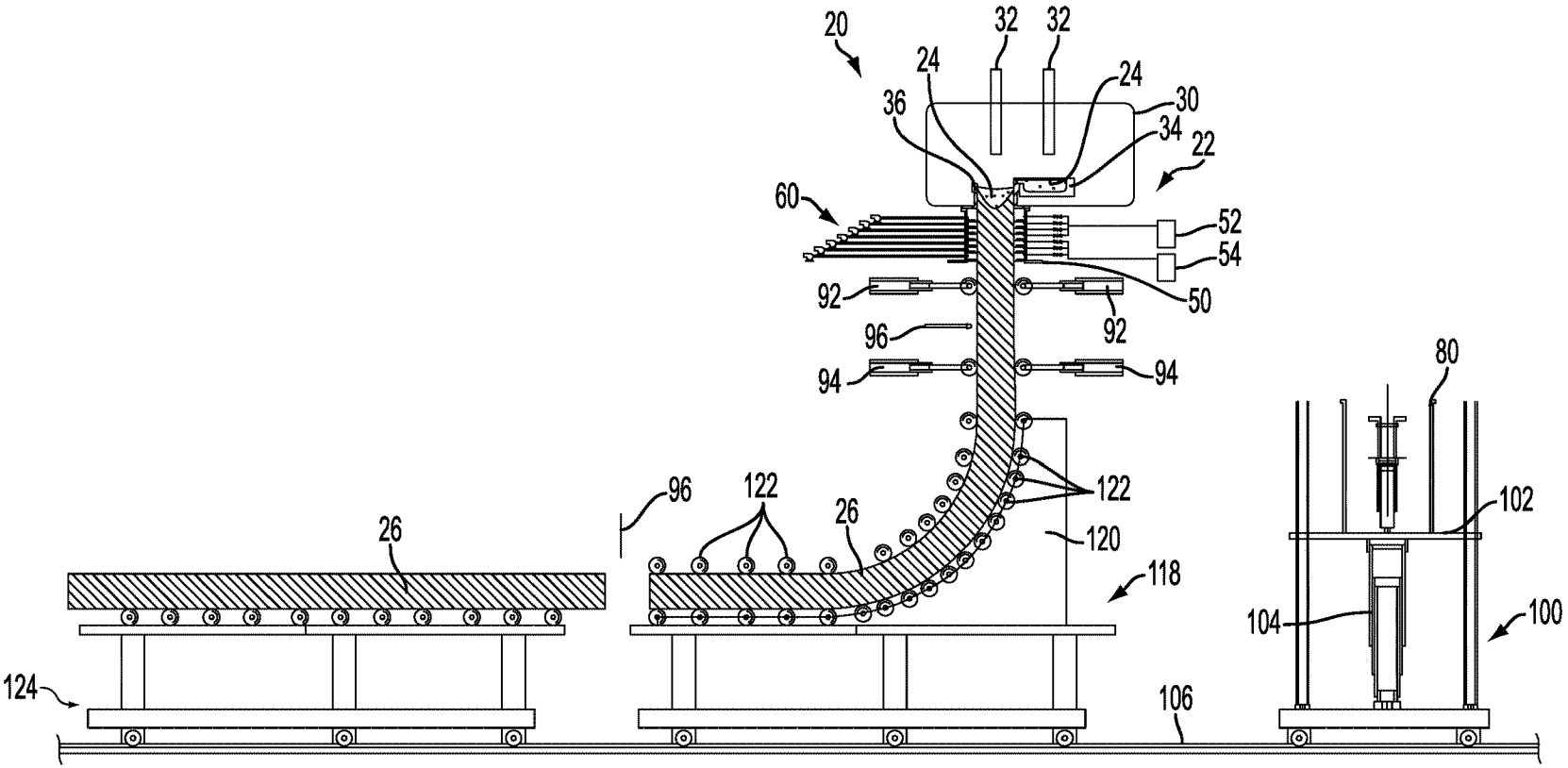
FIG. 10 is a schematic of the continuous casting system of FIG. 1 showing the withdrawal chamber and withdrawal cart removed from the furnace and an alternative unloading device unloading the cast material.
Figure 11:
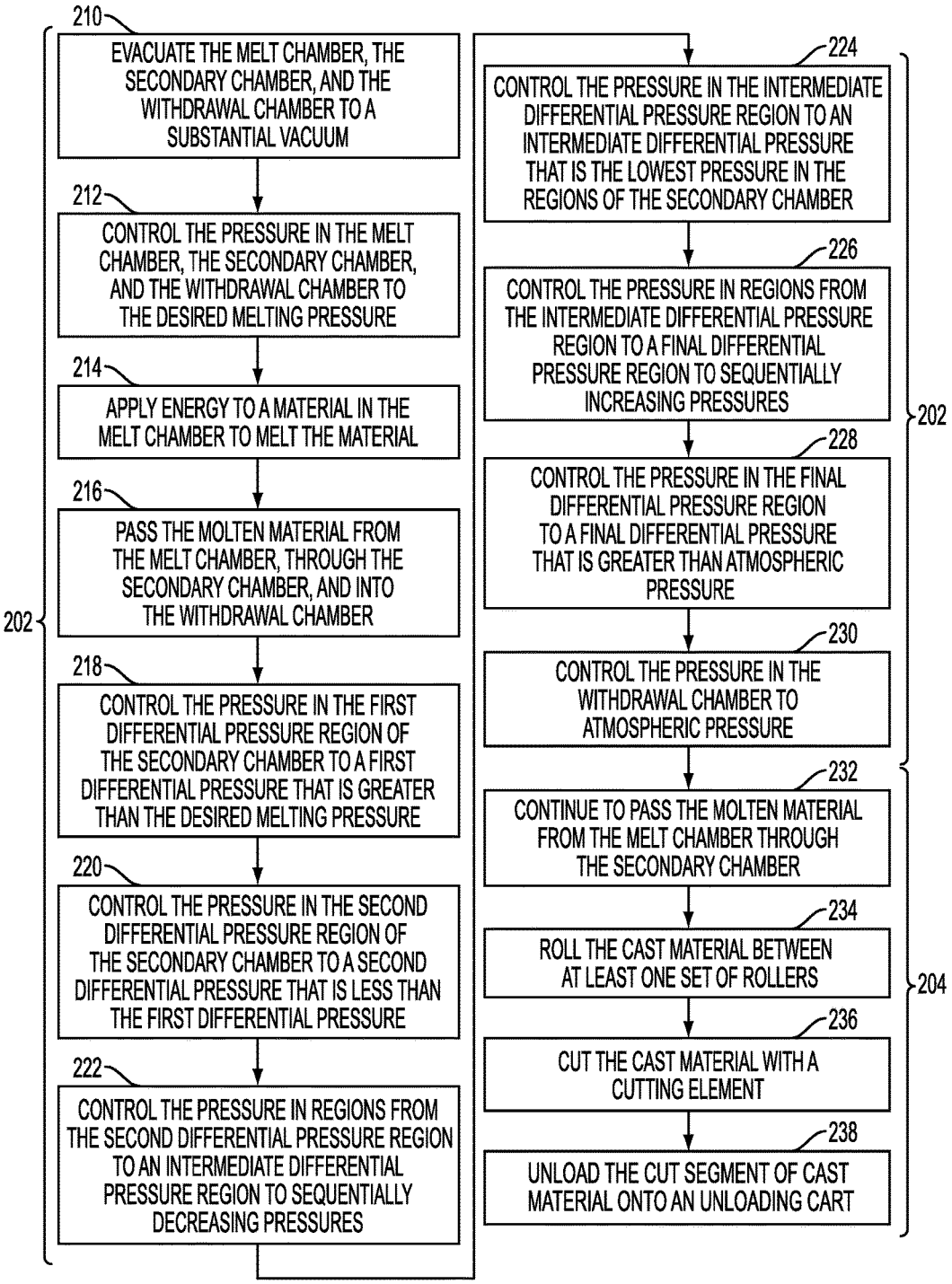
FIG. 11 is a flow diagram depicting a process for using the continuous casting system of FIG. 1 according to at least one non-limiting embodiment of the present disclosure.

Referring now to FIG. 10, in various non-limiting embodiments the continuous casting system 20 can include a second unloading device 118. In various non-limiting embodiments, the second unloading device 118 can include a support member 120 that holds additional rollers 122. In certain embodiments, the additional rollers 122 can steer the cast material 26 along a path formed by the support member 120 and/or by the additional rollers 122. The rollers 122 can steer the cast material 26 along a contoured path, for example, and can steer the cast material 26 from a vertical configuration to a horizontal configuration, for example. In various non-limiting embodiments, the cutting device 96 can cut a segment of the cast material 26 after the support member 120 has guided the cast material 26 to the desired configuration.

Referring primarily to FIGS. 1-11, operation of the continuous casting system 20 can include an initiation stage 202 and a continuous casting stage 204. In various non-limiting embodiments, the withdrawal chamber 80 can be sealed to the secondary chamber 50 during the initiation stage 202 of the casting operation. In certain non-limiting embodiments, when the withdrawal chamber 80 is released from the secondary chamber 50, the continuous casting stage 204 of the casting operation can begin. At step 210 of the initiation stage 202, the pumping system can evacuate the melt chamber 30, the secondary chamber 50, and the withdrawal chamber 80 to a vacuum or a substantial vacuum. For example, in certain non-limiting embodiments, the pressure in the melt chamber 30, the secondary chamber 50, and the withdrawal chamber 80 can be evacuated to a range of approximately 100 mTorr to approximately 10 mTorr. In various non-limiting embodiments, the melt chamber 30, the secondary chamber 50, and the withdrawal chamber 80 can have a low leak rate. For example, in various non-limiting embodiments, the chambers 30, 50, 80 can have a leak rate of approximately 10 mTorr increase/minute to less than approximately 5 mTorr increase/minute. The integrity of the seal between the melt chamber 30, the secondary chamber 50, and the withdrawal chamber 80 can be confirmed. At step 212, the pumping system can control the pressure in the melt chamber 30, the secondary chamber 50, and the withdrawal chamber 80 to the desired melting pressure. For example, when the desired melting pressure is a positive pressure, the chambers 30, 50, 80 can be backfilled with an inert gas to reach the desired melting pressure.

In various non-limiting embodiments, once the desired melting pressure is attained throughout the melt chamber 30, the secondary chamber 50, and the withdrawal chamber 80, step 214 can be initiated. At step 214, energy can be applied to material 24 in the melt chamber 30 to melt the material 24. Subsequently, at step 216, the molten material 24 can pass from the melt chamber 30, through the secondary chamber 50, and into withdrawal chamber 80. For example, material can enter the mold 36 as molten material 24 and can exit the mold 36 as cast material 26. The cast material 26 then passes through the secondary chamber 50 and into the withdrawal chamber 80, for example.

Furthermore, at step 218 of the initiation stage 202, the pressure in the first differential pressure region **62*a* can be controlled to a first differential pressure that is at least slightly greater than the desired melting pressure. Furthermore, at step 220, the pressure in second differential pressure region 62*b* can be controlled to a second differential pressure that is at least slightly less than the first differential pressure. In other words, the first differential pressure region 62*a* can be a high pressure region that separates the melt chamber 30 from the subsequent regions 62 of the secondary chamber 50 and prevents contamination of the melt chamber 30** by non-inert gases in the external atmosphere.

Additionally, at step 222 of the initiation stage 202, the pressure in subsequent region(s) 62 can be incrementally decreased between the second differential pressure region **62*b* and the intermediate differential pressure region 62*d*, for example. Further, at step 224, the intermediate differential pressure region 62*d* can be controlled to an intermediate differential pressure that is the lowest pressure in the regions 62 of the secondary chamber 50, for example. In other words, the intermediate differential pressure region 62***d* can be a low pressure region between the first differential pressure region 62*a* and the final differential pressure region 62*g*. Furthermore, at step 226, the pressure in subsequent regions between the intermediate differential pressure region 62*d* and the final differential pressure region 62*g* can be incrementally increased toward atmospheric pressure, for example. Additionally, at step 228, the pressure in the final differential pressure region 62*g* can be controlled to at least slightly greater than atmospheric pressure, for example.

Adjacent regions 62 can maintain or substantially maintain different pressures once the cast material 26 is positioned through the pressure management elements 64 that define the sides of region 62. Accordingly, in various non-limiting embodiments, the pressure in each region can be controlled anytime after the cast material 26 extends through the respective region 62. In various non-limiting embodiments, the pressure in the regions 62 of the secondary chamber 50 can be simultaneously controlled to different operating pressures, i.e., the first differential pressure, the intermediate differential pressure, the final differential pressure, etc, after the cast material 26 passes through the entire secondary chamber 50 and enters the withdrawal chamber 80. In other words, steps 218, 220, 222, 224, 226, and 228 can be initiated simultaneously. For example, once the cast material 26 enters into the withdrawal chamber 80, the pumping system can be activated to initiate steps 218, 220, 222, 224, 226, and 228. Additionally or alternatively, the pressure in the regions 62 can be sequentially controlled as the cast material 26 progresses through the secondary chamber 50. For example, step 218 can be followed by step 220, which can be followed by step 222, which can be followed by step 224, which can be followed by step 226, which can be followed by step 228. In various non-limiting embodiments, the pressure in each region 62 can be adjusted after the cast material pass through the region 62. In other embodiments, the steps can be performed in a different order.

Also during the initiation stage 202 at step 230, the withdrawal chamber 80 can be controlled to atmospheric pressure. In various non-limiting embodiments, the withdrawal chamber 80 can be released from the secondary chamber 50 to attain atmospheric pressure. In other words, release of the withdrawal chamber 80 can break the seal between the secondary chamber 50 and the withdrawal chamber 80. Furthermore, when the withdrawal chamber 80 is released from the secondary chamber, the continuous casting system 20 can operate such that the cast material 26 can continue to extend from the mold 36. In various non-limiting embodiments, the withdrawal chamber 80 releases from the secondary chamber 50 to provide space for the extending length of cast material 26.

During the continuous casting stage 204 of the casting operation, molten material 24 can continue to pass from the melt chamber 30 through the secondary chamber 50, i.e., step 232. In various non-limiting embodiments, the withdrawal chamber 80 can remain released and/or removed from the secondary chamber 50. Accordingly, the cast material 26 can continue to flow from the melt chamber 30, which is maintained at the desired melting pressure, through the secondary chamber 50, which is controlled to various differential pressures throughout, and into the external atmosphere. The molten seal 28 and the dynamic airlock of secondary chamber 50 can prevent contamination of the melt chamber 30 by the external atmosphere in the withdrawal chamber and/or outside of the secondary chamber 50. Furthermore, in various non-limiting embodiments, at step 234, the cast material can be rolled between the set of primary and/or secondary rollers 92, 94; at step 236, the cast material 26 can be cut by the cutting device 96; and/or, at step 238, the cast material 26 can be unloaded by one of the unloading devices 110, 118, for example. The cast material 26 can be rolled between the set of primary and/or secondary rollers 92, 94 before and/or after the cast material 26 is cut by the cutting device 96, for example. Further, the cast material 26 can be cut by the cutting device 96 before and/or after the cast material 26 is unloaded by one of the unloading devices 110, 118, for example. The continuous casting stage 204 of the continuous casting operation can continue until no additional material 24 is fed into the mold 36.

Although various embodiments of equipment, systems, and methods described herein are discussed in connection with casting of reactive metals and metal alloys, it will be understood that the present inventions are not so limited and may be used in connection with the casting of any metals or metal alloys, whether or not reactive when molten or at high temperature.

Various embodiments are described and illustrated in this specification to provide an overall understanding of the elements, steps, and use of the disclosed device and methods. It is understood that the various embodiments described and illustrated in this specification are non-limiting and non-exhaustive. Thus, the invention is not limited by the description of the various non-limiting and non-exhaustive embodiments disclosed in this specification. In appropriate circumstances, the features and characteristics described in connection with various embodiments may be combined, modified, or reorganized with the steps, components, elements, features, aspects, characteristics, limitations, and the like of other embodiments. Such modifications and variations are intended to be included within the scope of this specification. As such, the claims may be amended to recite any elements, steps, limitations, features, and/or characteristics expressly or inherently described in, or otherwise expressly or inherently supported by, this specification. Further, Applicants reserve the right to amend the claims to affirmatively disclaim elements, steps, limitations, features, and/or characteristics that are present in the prior art regardless of whether such features are explicitly described herein. Therefore, any such amendments comply with the requirements of 35 U.S.C. § 112, first paragraph, and 35 U.S.C. § 132(a). The various embodiments disclosed and described in this specification can comprise, consist of, or consist essentially of the steps, limitations, features, and/or characteristics as variously described herein.

Any patent, publication, or other disclosure material identified herein is incorporated by reference into this specification in its entirety unless otherwise indicated, but only to the extent that the incorporated material does not conflict with existing definitions, statements, or other disclosure material expressly set forth in this specification. As such, and to the extent necessary, the express disclosure as set forth in this specification supersedes any conflicting material incorporated by reference herein. Any material, or portion thereof, that is said to be incorporated by reference into this specification, but which conflicts with existing definitions, statements, or other disclosure material set forth herein, is only incorporated to the extent that no conflict arises between that incorporated material and the existing disclosure material. Applicants reserve the right to amend this specification to expressly recite any subject matter, or portion thereof, incorporated by reference herein.

The grammatical articles "one", "a", "an", and "the", if and as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

The invention claimed is:

1. A system for melting and casting material, comprising:

a melt chamber structured to operably attain a melting pressure above atmospheric pressure;

a secondary chamber comprising:

a plurality of regions, wherein the plurality of regions comprises:

a first region positioned adjacent to the melt chamber;

a final region; and a negative pressure seal positioned intermediate the first region and the final region;

a pumping system comprising at least one pump, the pumping system separately adjusting the melting pressure and a pressure in each region of the plurality of regions of the secondary chamber;

at least one pressure management element, wherein each pressure management element controls a flow of gas between adjacent regions of the plurality of regions, and wherein the first region is structured to operably attain a first differential pressure that is greater than the melting pressure;

a withdrawal chamber positioned adjacent to the secondary chamber, wherein the withdrawal chamber is structured to operably attain atmospheric pressure, and wherein the withdrawal chamber is moveably positionable relative to the secondary chamber; and rollers configured to move between a first position retracted from cast material when the withdrawal chamber is positioned adjacent to the secondary chamber, and a second position extended toward the cast material when the withdrawal chamber is moved away from the secondary chamber.

2. The system of claim 1, wherein the secondary chamber comprises an inner perimeter, and wherein each pressure management element comprises:

a baffle; and a central aperture for receiving cast material therethrough, wherein the baffle of each pressure management element extends from the inner perimeter to the central aperture.

3. The system of claim 2, wherein the melt chamber comprises a mold for casting material, and wherein the cast material is structured to pass from the mold, through the central aperture of the at least one pressure management element of the secondary chamber, and into the withdrawal chamber.

4. The system of claim 1, wherein the plurality of regions comprises a second region adjacent to the first region, and wherein the second region is structured to operably attain a second differential pressure that is less than the first differential pressure.

5. The system of claim 1, wherein the pumping system comprises a plurality of pumps structured to adjust the pressure in the plurality of regions of the secondary chamber.

6. The system of claim 5, wherein the pump corresponding to the first region is structured to adjust the pressure of the first region from the melting pressure to the first differential pressure when a portion of cast material extends through the first region.

7. The system of claim 5, wherein the final region is positioned adjacent to the withdrawal chamber, wherein the pump corresponding to the final region is structured to adjust the pressure in the final region from the melting pressure to a final differential pressure when a portion of cast material extends through the final region, and wherein the final differential pressure is greater than atmospheric pressure.

8. The system of claim 5, wherein the plurality of regions comprises an intermediate region between the first region and the final region, wherein the pump corresponding to the intermediate region is structured to adjust the pressure in the intermediate region from the melting pressure to the intermediate differential pressure when a portion of cast material extends through the intermediate region, and wherein the intermediate differential pressure is less than the first and final differential pressures.

9. The system of claim 8, wherein the plurality of pumps operably decreases the pressure between adjacent regions from the first region to the intermediate region and operably increases the pressure between adjacent regions from the intermediate region to the final region.

10. The system of claim 1, wherein the pumping system comprises a plurality of pumps structured to adjust a volume of a gas in each region of the plurality of regions to generate the pressure therein, and wherein the gas in the regions from the first region to the intermediate region consists essentially of inert gases.

11. The system of claim 1, comprising a withdrawal cart structured to move the withdrawal chamber away from the secondary chamber, wherein the withdrawal chamber is structured to attain atmospheric pressure upon moving away from the secondary chamber.

12. The system of claim 1, wherein the secondary chamber further comprises an intermediate region positioned intermediate the first region and the final region, wherein the first region comprises a first higher pressure region comprising a first operating pressure, wherein the final region comprises a second higher pressure region comprising a second operating pressure, and wherein the intermediate region comprises a lower pressure region comprising a third operating pressure that is less than the first operating pressure and the second operating pressure.

* * * * *